US007171960B1

(12) United States Patent
Hagari

(10) Patent No.: US 7,171,960 B1
(45) Date of Patent: Feb. 6, 2007

(54) CONTROL APPARATUS FOR AN INTERNAL COMBUSTION ENGINE

(75) Inventor: Hideki Hagari, Tokyo (JP)

(73) Assignee: Mitsubishi Denki Dabushiki Kaisha, Tokyo (JP)

( * ) Notice: Subject to any disclaimer, the term of this patent is extended or adjusted under 35 U.S.C. 154(b) by 0 days.

(21) Appl. No.: 11/411,807

(22) Filed: Apr. 27, 2006

(30) Foreign Application Priority Data

Nov. 28, 2005 (JP) ..... 2005-341531

(51) Int. Cl.
*F02D 41/14* (2006.01)
*F02M 33/04* (2006.01)

(52) U.S. Cl. ..... 123/698; 123/520; 123/472

(58) Field of Classification Search ..... 123/520, 123/698, 472
See application file for complete search history.

(56) References Cited

U.S. PATENT DOCUMENTS 5,626,122 A * 5/1997 Azuma ..... 123/698
6,321,735 B2 * 11/2001 Grieve et al. ..... 123/520
6,523,531 B1 * 2/2003 Feldkamp et al. ..... 123/520
6,666,200 B2 * 12/2003 Davis et al. ..... 123/698
6,722,347 B2 * 4/2004 Sanchez et al. ..... 123/520

FOREIGN PATENT DOCUMENTS

JP 3376172 B2 11/2002
JP 3409891 B2 3/2003
JP 3511722 B2 1/2004

* cited by examiner

*Primary Examiner*—Erick Solis
(74) *Attorney, Agent, or Firm*—Sughrue Mion, PLLC

(57) ABSTRACT

A control apparatus for an internal combustion engine prevents variation of an air fuel ratio even upon introduction of purge air. A delay time occurring until the intake air detected, after having arrived at the combustion chamber through a surge tank, influences an air fuel ratio sensor, a delay time occurring until purge air containing evaporated fuel generated upon purging a canister, after having arrived at the combustion chamber through the surge tank, influences the air fuel ratio sensor, and a delay time occurring until fuel supplied by an injector, after having arrived at the combustion chamber, influences the air fuel ratio sensor, are represented by simplified physical models. A purge rate in the combustion chamber or in the neighborhood of the air fuel ratio sensor is calculated by using the physical models, and a purge air concentration and a fuel correction amount are calculated based on the purge rate thus obtained.

11 Claims, 8 Drawing Sheets

ECU
20
FROM 9
FROM 15
FROM 18
TO 17
TO 12
6
7
5
12
13
8
18
TO 20
FROM 20
FROM 20
17
9
TO 20
15
TO 20
14
3
4
3a
16
11
1
2
10

CONTROL APPARATUS FOR AN INTERNAL COMBUSTION ENGINE

BACKGROUND OF THE INVENTION

1. Field of the Invention

The present invention relates to a control apparatus for an internal combustion engine that serves to temporarily store evaporated fuel generated in a fuel tank or the like into a canister (evaporated fuel adsorption device), and introduce it into an intake system of the internal combustion engine as purge air together with air. Also, the invention relates to a control apparatus for an internal combustion engine that serves to introduce evaporated fuel that leaked from a gap between a cylinder and a piston received therein of the internal combustion engine into an intake system thereof as a blowby gas together with air. More specifically, the invention relates to a control apparatus for an internal combustion engine capable of achieving excellent air fuel ratio control even in case a large amount of evaporated fuel is processed or treated.

2. Description of the Related Art

In the past, there has been known an evaporated fuel treatment device in which evaporated fuel generated in a fuel supply system such as a fuel tank of an internal combustion engine, after being adsorbed to and stored in a canister, is mixed with air and introduced into an intake system thereby to purify (or purge) the canister (see, for example, a first patent document: Japanese patent No. 3511722).

In addition, it is also generally known that when the evaporated fuel adsorbed to the canister is introduced into the intake system together with air, there will occur a deviation between an actual air fuel ratio and a target air fuel ratio that is a target to be controlled in accordance with the concentration of the evaporated fuel in the purge air.

Accordingly, in the conventional apparatus as described in the above-mentioned first patent document, the actual air fuel ratio is brought close to the target air fuel ratio by correcting the amount of fuel to be injected according to air fuel ratio feedback control. Specifically, provision is made for a means for calculating the concentration of purge air in an intake air from a purge rate and a corrected amount of fuel according to the air fuel ratio feedback control, and correcting the amount of fuel to be injected in accordance with the purge rate and the purge air concentration.

Here, note that purge air is introduced into a surge tank from a purge passage (generally connected to an upstream side of the surge tank), and air sucked through an air flow sensor is introduced into the surge tank through a throttle valve.

Moreover, the fuel injected from an injector is introduced into an intake port and/or a combustion chamber, and an air fuel ratio sensor for detecting the air fuel ratio is arranged in an exhaust passage (generally, a collected portion of the exhaust passage in which exhaust gases from respective cylinders are collected together).

On the other hand, there has also been proposed an apparatus with an actual purge rate estimation section that estimates, in consideration of the occurrence of a transport delay of air in the intake system of the internal combustion engine, a purge rate (actual purge rate) in a mixture actually sucked into a combustion chamber of the internal combustion engine based on the conductive state of the purge passage before a predetermined period of time (see, for example, a second patent document: Japanese patent No. 3409891).

In the conventional apparatus described in the second patent document, the conductive state of the purge passage is stored at each sampling time interval, and a delay time is decided in accordance with the operating condition of the internal combustion engine, whereby an amount of purge flow contained in the intake air to be sucked into the internal combustion engine is accurately estimated while further applying gradually changing processing (filtering processing) thereto in accordance with the operating condition of the internal combustion engine.

In addition, there has been proposed an apparatus including a purge detection delay calculation section for calculating a purge detection delay time from a time point at which purge air is introduced into an intake system until a time point at which the purge air thus introduced is actually detected as an air fuel ratio by means of an air fuel ratio sensor installed on an exhaust system (see, for example, a third patent document: Japanese patent No. 3376172).

The purge detection delay calculation section described in the above-mentioned third patent document calculates the purge detection delay time based on an intake air transport delay time from the air flow sensor to the intake system, a correction time due to the charging efficiency of the intake system, the length of an exhaust passage from a combustion chamber to the air fuel ratio sensor, and a response delay time of the air fuel ratio sensor.

In the above-mentioned conventional control apparatus for an internal combustion engine, attention is primarily focused on the transport delay of purge air alone, but in actuality, purge air is introduced from a purge passage into a surge tank, into which intake air is also introduced through a throttle valve, and fuel injected from an injector is led into an intake port (or combustion chamber), with the air fuel ratio sensor being installed on the exhaust passage. As a result, it is necessary to correct the amount of fuel to be injected by calculating the concentration of purge air from the air fuel ratio detected by the air fuel ratio sensor while taking into consideration all the transport delays of the purge flow rate (the flow rate of purge air), the amount of intake air and the amount of fuel which are used for controlling the air fuel ratio.

According to the above control that considers only the transport delay of purge air, as in the above-mentioned conventional apparatuses, there arises the following problem. That is, particularly, in case where the amount of purge air introduced changes greatly great, or where the amount of intake air changes greatly, there occurs a deviation in phase of the purge flow rate, the amount of intake air, and the amount of correction for the amount of fuel injected by the injector, so the air fuel ratio cannot be maintained to a target air fuel ratio (e.g., stoichiometric air fuel ratio), and, as a result, the exhaust gas is deteriorated.

Also, there are the following additional problems in the above-mentioned conventional apparatuses. Since the amount of data required to be set is large, resultant calibration man-hours increase, and besides, the memory capacity used in a digital computer of a controller becomes large, thus inviting an increase in size and cost.

For example, in the conventional apparatus as described in the above-mentioned second patent document, a memory means is required for storing the conductive state of the purge passage at each sampling time interval, so the memory capacity required becomes large, and in order to decide the delay times in accordance with the operating condition of the internal combustion engine, or in order to perform gradually changing processing in accordance with the operating condition of the internal combustion engine, calibration man-hours required accordingly increase.

In addition, in the conventional apparatus as described in the above-mentioned third patent document, the settings of the intake air transport delay time, the correction time due to the charging efficiency, and the response delay time of the air fuel ratio sensor are needed, so the amount of data for which settings are necessary increases, thus resulting in accordingly increased calibration man-hours.

SUMMARY OF THE INVENTION

Accordingly, the object of the present invention is to obtain a control apparatus for an internal combustion engine which is capable of reducing calibration man-hours and the memory capacity necessary for a microcomputer by introducing a relatively simplified physical model of an internal combustion engine, of further eliminating, even under the state of transient operation, a deviation in phase of a purge flow rate, an amount of intake air, and a correction amount for an amount of fuel to be injected by an injector while taking account of all the transport delays of the purge flow rate, the amount of intake air, and the amount of fuel, and of achieving, as a result, excellent air fuel ratio control even when a large amount of evaporated fuel is processed or treated.

Bearing the above object in mind, according to the present invention, there is provided a control apparatus for an internal combustion engine including: a canister that temporarily adsorbs and stores evaporated fuel generated in a fuel supply system including a fuel tank; a purge control valve that is arranged in a purge passage connecting between said canister and an intake system of an internal combustion engine for controlling the flow rate of purge air comprising a mixture of said evaporated fuel and air when said purge air is introduced into said intake system; an injector that is arranged in the neighborhood of an intake port or in a combustion chamber of said internal combustion engine for supplying fuel to said internal combustion engine; an operating condition detection section that detects an operating condition of said internal combustion engine; and an air fuel ratio sensor that is arranged in an exhaust system of said internal combustion engine for detecting an air fuel ratio in an exhaust gas. The apparatus further includes: a target purge rate calculation section that calculates, as a target purge rate, a target value of a purge rate that is a ratio between an amount of intake air of said internal combustion engine and said purge flow rate, based on said engine operating condition; a target purge flow rate calculation section that calculates a target purge flow rate based on said engine operating condition and said target purge rate; a purge flow rate control section that controls said purge control valve so that said purge flow rate becomes said target purge flow rate; and an air fuel ratio feedback control section that controls an amount of fuel supplied from said injector in a feedback manner so that said air fuel ratio becomes a target air fuel ratio. The apparatus further includes: a purge air transport delay calculation section that calculates a combustion chamber purge flow rate based on a transport delay that occurs until the purge air supplied to said intake system through said purge control valve reaches said combustion chamber, and also calculates an air fuel ratio sensor neighborhood purge flow rate based on a transport delay that occurs until said purge air exerts an influence on the value of said air fuel ratio detected by said air fuel ratio sensor; an intake air transport delay calculation section that calculates a combustion chamber intake air amount based on a transport delay that occurs until intake air detected by said operating condition detection section reaches the interior of said combustion chamber, and also calculates an air fuel ratio sensor neighborhood intake air amount based on a transport delay that occurs until said intake air exerts an influence on the value of said air fuel ratio detected by said air fuel ratio sensor; and a fuel transport delay calculation section that calculates an air fuel ratio sensor neighborhood fuel amount based on a transport delay that occurs until the fuel supplied by said injector exerts an influence on the value of said air fuel ratio detected by said air fuel ratio sensor. The apparatus further includes: a combustion chamber purge rate calculation section that calculates a combustion chamber purge rate based on said combustion chamber purge flow rate and said combustion chamber intake air amount; an air fuel ratio sensor neighborhood purge rate calculation section that calculates an air fuel ratio sensor neighborhood purge rate based on said air fuel ratio sensor neighborhood purge flow rate and said air fuel ratio sensor neighborhood intake air amount; a purge air concentration calculation section that calculates a purge air concentration based on said air fuel ratio sensor neighborhood purge rate, said air fuel ratio sensor neighborhood intake air amount, said air fuel ratio sensor neighborhood fuel amount, and the air fuel ratio detected by said air fuel ratio sensor; a purge air concentration learning value calculation section that calculates a purge air concentration learning value by applying averaging processing or filtering processing to said purge air concentration; and a fuel amount correction section that corrects the amount of fuel to be supplied to said internal combustion engine based on said combustion chamber purge rate and said purge air concentration learning value.

According to the present invention, the concentration of purge air and the purge air concentration fuel correction coefficient are calculated in consideration of the transport delays of the purge air, the intake air and the fuel introduced into the internal combustion engine, so it is possible to suppress the variation of the air fuel ratio even in the case of a transient operation of the engine or in the case of a change in the purge flow rate.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Hereinafter, preferred embodiments of the present invention will be described in detail while referring to the accompanying drawings.

Embodiment 1

Figure 1:
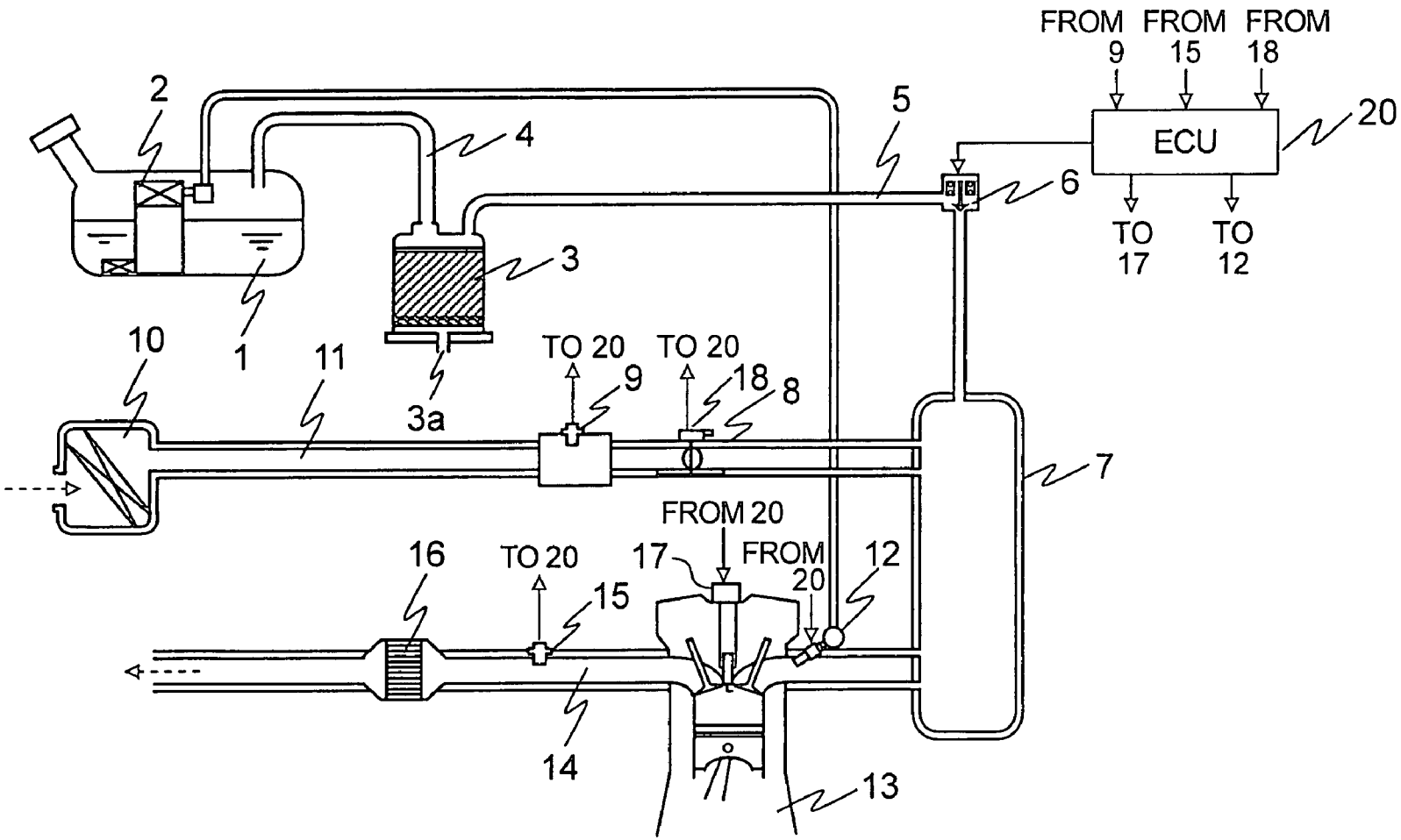
FIG. 1 is a construction view showing a control apparatus for an internal combustion engine according to a first embodiment of the present invention.

FIG. 1 is a construction view that conceptually shows a control apparatus for an internal combustion engine with an evaporated fuel treatment device according to a first embodiment of the present invention.

In FIG. 1, in a fuel tank 1 in which fuel is filled, there is arranged a fuel pump 2 that serves to supply the fuel to an injector 12 of an internal combustion engine 13. An upper portion in the fuel tank 1 is placed in communication with one end of a canister 3 through an evaporated fuel passage 4. The canister 3 has the other end thereof placed in communication with a surge tank 7 arranged in an intake system through a purge passage 5, in which a purge control valve 6 is arranged.

In an intake passage 11 of the internal combustion engine 13, there are arranged the surge tank 7, a throttle valve 8, an air flow sensor 9 and the injector 12, with an air cleaner 10 being arranged at an upstream and of the intake passage 11. A throttle opening sensor 18 for detecting the degree of opening of the throttle valve 8 (hereinafter also referred to as the throttle opening) is mounted on the throttle valve 8. The air sucked into the intake passage 11 through the air cleaner 10 is supplied to the internal combustion engine 13 through the air flow sensor 9, the throttle valve 8 and the surge tank 7. The air flow sensor 9 arranged in the intake passage 11 detects an amount of intake air sucked therein through the air cleaner 10, and inputs it to an ECU 20 (electronic control unit including various calculation processing sections, etc.). The throttle valve 8 controls the amount of intake air supplied to the internal combustion engine 13 in accordance with an amount of operation of an accelerator (not shown) given by a driver. The throttle opening sensor 18 serves to detect the position of the throttle valve 8 as a throttle opening, and input it to the ECU 20.

Here, note that in case where the throttle valve 8 is assumed to be of a mechanical type, though not illustrated here, in general, a bypass passage bypassing the throttle valve 8 is arranged in the intake passage 11, with an ISC (idle speed control) valve being provided in the bypass passage. The ISC (idle speed control) valve is driven to open and close under the control of the ECU 20 when the throttle valve 8 is fully closed (i.e., at the time of idle operation).

In addition, though not illustrated here, the internal combustion engine 13 is generally provided with a blowby gas passage, through which a blowby gas comprising a mixture of evaporated fuel and air leaked from a gap between a cylinder and a piston received therein into a crankcase is introduced into the intake system (the surge tank 7). In the blowby gas passage, there is arranged a blowby gas control valve that controls the amount of blowby gas when the blowby gas is introduced into the intake system of the internal combustion engine 13, so that the blowby gas control valve is driven to open and close under the control of the ECU 20.

The injector 12 is arranged in an intake manifold connected to the intake passage 11 at a downstream side of the surge tank 7 for injecting fuel, which is pressure fed by the fuel pump 2 in the fuel tank 1, into intake air at an intake side of the internal combustion engine 13, whereby a mixture of the intake air and the fuel is supplied to the internal combustion engine 13. Here, note that in the case of a direct cylinder injection type internal combustion engine (not shown), the injector 12 is arranged directed to a combustion chamber of the internal combustion engine 13.

An ignition coil 17 is mounted on a cylinder head with an ignition plug being presented in the combustion chamber of the internal combustion engine 13, and an air fuel ratio sensor 15 and a three-way catalyst 16 are arranged on an exhaust passage 14 of the internal combustion engine 13. The air fuel ratio sensor 15 detects the air fuel ratio of an exhaust gas in the vicinity of a collected portion of an exhaust manifold connected to the exhaust passage 14, and inputs it to the ECU 20 as a corresponding electric signal.

The three-way catalyst 16, functioning as an exhaust gas cleaning or purification catalyst, is arranged at a downstream side of the air fuel ratio sensor 15 so as to oxidize harmful gases (e.g., CO, HC) in the exhaust gas and at the same time to reduce NOx therein at a predetermined air fuel ratio (e.g., stoichiometric air fuel ratio) thereby to purify the exhaust gas. The canister 3 constitutes the evaporated fuel treatment device for preventing the fuel evaporated in the fuel tank 1 from escaping into the ambient atmosphere, and has an activated carbon bed that serves to adsorb the fuel evaporated from the fuel tank 1. Connected to the canister 3 at one side of the activated carbon bed therein (an upper side in FIG. 1) are the evaporated fuel passage 4 connecting between the fuel tank 1 and the canister 3, and the purge passage 5 connecting between the canister 3 and the surge tank 7 (the intake system), with an atmospheric opening 3*a* being formed through the canister 3 at the other side of the activated carbon bed. The purge control valve 6 arranged in the purge passage 5 comprises an electromagnetic valve that is driven to open and close under the control of the ECU 20, thereby controlling the flow rate of purge air upon introduction thereof into the intake system.

The ECU 20 includes a digital computer and an I/F circuit, and the digital computer is provided with a RAM, a ROM, a CPU, an input port, an output port, etc., that are mutually connected to one another through a bilateral bus, as is well known in the art. The ECU 20 controls various kinds of actuators such as the purge control valve 6, etc., based on detected information (e.g., the engine operating condition) from various kinds of sensors such as the air flow sensor 9, etc. The CPU in the ECU 20 executes a control program for the internal combustion engine 13 stored in the ROM with the use of the RAM, whereby various kinds of calculation processes are performed based on the detected information obtained from the input port, thereby controlling the output port for the various kinds of actuators. The input port and the output port of the ECU 20 are connected through the I/F circuit to the various kinds of sensors that detect the operating condition of the internal combustion engine 13, and to the various kinds of actuators that control the operating condition of the internal combustion engine 13. Though not indicated in FIG. 1, connected to the input port are other various kinds of sensors (operating condition detection section) such as a rotation sensor for detecting the rotation (i.e., the rotational speed or the number of revolutions per minute) of the internal combustion engine 13, an atmospheric pressure sensor for detecting the atmospheric pressure, an intake air temperature sensor for detecting the temperature of intake air, a water temperature sensor for detecting the temperature of engine cooling water, a knock sensor for detecting knock vibration, etc.

In order to control the internal combustion engine 13, the ECU 20 calculates control quantities for the various kinds of actuators, respectively, based on environmental conditions around the internal combustion engine 13 and the operating condition of the internal combustion engine 13 obtained from the various kinds of sensors. Specifically, in particular, an amount of fuel Qf to be injected by the injector 12 and timing at which the air fuel mixture in the combustion chamber is fired by the ignition coil 17 and the spark plug are calculated based on the number of revolutions per minute of the internal combustion engine 13 obtained from the rotation sensor (not shown) and the amount of intake air obtained from the air flow sensor 9, so that the injector 12 and the ignition coil 17 connected to the output port are driven to operate based on the calculation results.

The calculation processing of the amount of fuel Qf is performed by calculating a basic fuel amount that achieves the stoichiometric air fuel ratio with respect to a value (e.g., charging efficiency) corresponding to the amount of intake air that is sucked during one stroke of the internal combustion engine 13, and by applying corrections to the basic fuel amount. That is, a final amount of fuel Qf is calculated by applying to the basic fuel amount corrections such as air fuel ratio correction, warming-up correction, corrections at and after engine starting, etc. In addition, air fuel ratio feedback control is also carried out to correct the basic fuel amount so as to achieve a target air fuel ratio in accordance with the air fuel ratio detected by the air fuel ratio sensor 15.

Further, the ECU 20 controls the evaporated fuel treatment device including the canister 3 by controlling to open and close the purge control valve 6. First of all, the evaporated fuel generated in the fuel supply system including the fuel tank 1 is temporarily adsorbed to the activated carbon bed in the canister 3 irrespective of whether the internal combustion engine 13 is in operation or stopped. The adsorption capacity of the activated carbon bed in the canister 3 is limited, so it is necessary to purge the evaporated fuel adsorbed to and stored in the activated carbon bed. As a method for purging the canister 3, it is general to use negative pressure generated in the surge tank 7 during operation of the internal combustion engine 13. That is, when the purge control valve 6 is opened during operation of the internal combustion engine 13, there is generated a flow in the purge passage 5 from the atmospheric opening 3*a* of the canister 3 toward the surge tank 7 under the action of negative pressure in the surge tank 7. As a result, the air introduced from the atmospheric opening 3*a* of the canister 3 is introduced into the surge tank 7 as a mixture or purge air containing evaporated fuel released from the activated carbon during passage through the activated carbon bed. The flow rate of the purge air at this time is controlled by the purge control valve 6.

Thereafter, the purge air is introduced into the combustion chamber of the internal combustion engine 13 while being mixed with the intake air in the surge tank 7 through the air flow sensor 9 and the throttle valve 8. Subsequently, the mixture thus introduced into the combustion chamber is combusted or burned together with the fuel injected from the injector 12 due to interruption of energization of the ignition coil 17, whereby the evaporated fuel generated in the fuel tank 1 is finally subjected to combustion treatment, as a result of which the evaporated fuel in the fuel tank 1 is prevented from being released into the atmosphere.

Figure 2:
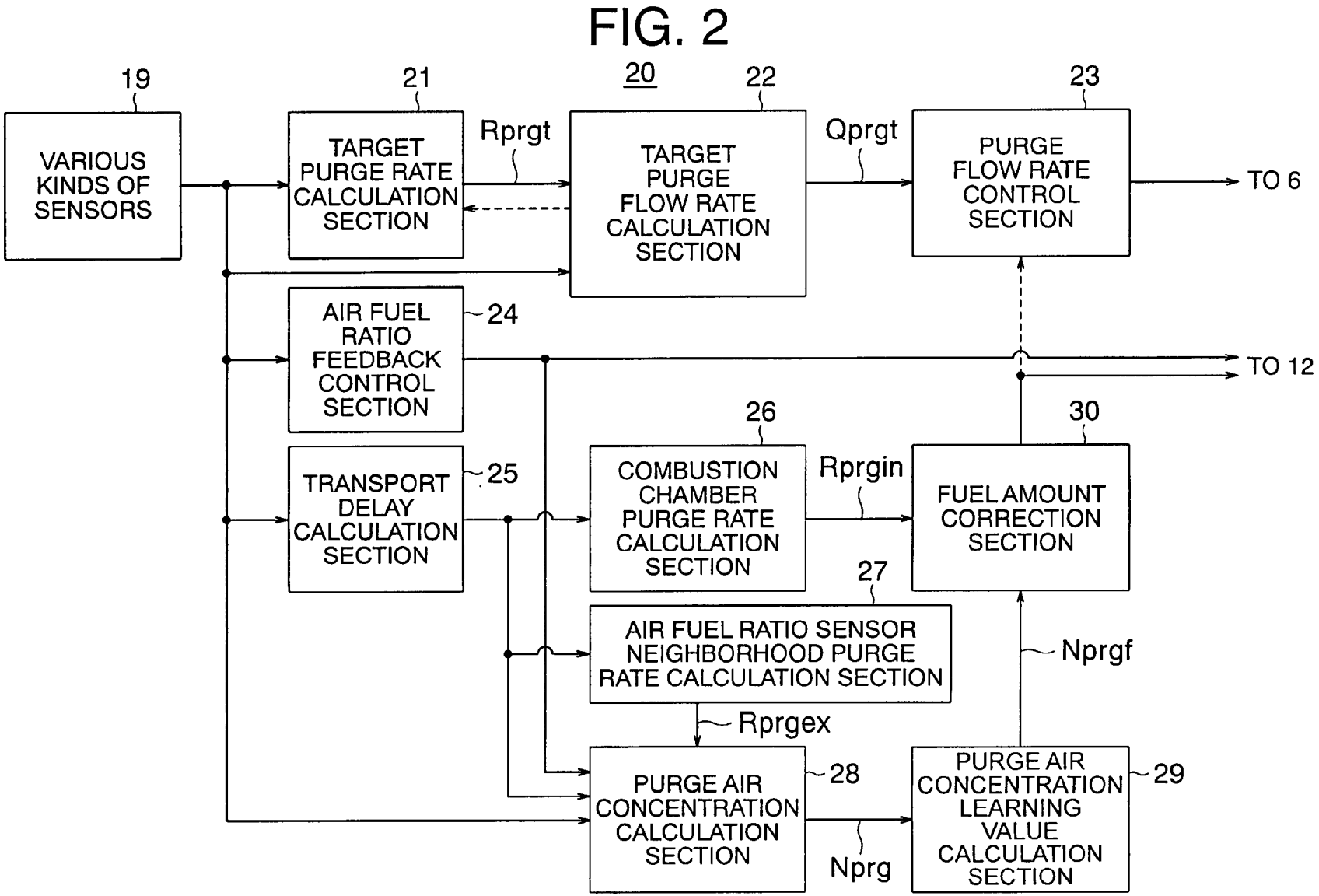
FIG. 2 is a block diagram illustrating the functional configuration of an ECU in FIG. 1.

FIG. 2 is a block diagram illustrating the functional configuration of the ECU 20. In FIG. 2, in order to control the purge control valve 6 and the injector 12 based on the detected information from various kinds of sensors 19 such as the air fuel ratio sensor 15, etc., the ECU 20 includes a target purge rate calculation section 21, a target purge flow rate calculation section 22, a purge flow control section 23, an air fuel ratio feedback control section 24, a transport delay calculation section 25, a combustion chamber purge rate calculation section 26, an air fuel ratio sensor neighborhood purge rate calculation section 27, a purge air concentration calculation section 28, a purge air concentration learning value calculation section 29, and a fuel amount correction section 30.

The target purge rate calculation section 21 calculates, based on the operating condition of the internal combustion engine 13, a target value (target purge rate) Rprgt of the purge rate that is the ratio of the amount of intake air and the purge flow rate.

The target purge flow rate calculation section 22 calculates a target purge flow rate Qprgt based on the engine operating condition and the target purge rate Rprgt, and clips the target purge rate Rprgt based on a purge flow rate maximum value Qprgmax (to be described later) (see a broken line arrow).

The purge flow control section 23 controls the purge control valve 6 in such a manner that the purge flow rate becomes the target purge flow rate Qprgt.

The air fuel ratio feedback control section 24 calculates a target air fuel ratio based on the operating condition of the internal combustion engine 13, and controls the amount of fuel Of supplied from the injector 12 in a feedback manner by driving the injector 12 so as to make the air fuel ratio detected by the air fuel ratio sensor 15 coincide with the target air fuel ratio.

The transport delay calculation section 25 includes a purge air transport delay calculation section, an intake air transport delay calculation section, and a fuel transport delay calculation section. The purge air transport delay calculation section in the transport delay calculation section 25 calculates an amount of purge air or purge flow rate in the combustion chamber (hereinafter referred to as a combustion chamber purge flow rate) based on a transport delay that occurs until the purge air supplied to the intake system through the purge control valve 6 actually reaches the combustion chamber, and also calculates a purge flow rate in the neighborhood of the air fuel ratio sensor 15 (hereinafter referred to as an air fuel ratio sensor neighborhood purge flow rate) based on the transport delay that occurs until the purge air exerts an influence on the value of the air fuel ratio detected by the air fuel ratio sensor 15.

The intake air transport delay calculation section in the transport delay calculation section 25 calculates an amount of intake air in the combustion chamber (hereinafter referred to as a combustion chamber intake air amount) based on a transport delay that occurs until the intake air detected by the air flow sensor 9 included in the various kinds of sensors 19 actually reaches the interior of the combustion chamber, and also calculates the amount of intake air in the neighborhood of the air fuel ratio sensor 15 (hereinafter referred to as an air fuel ratio sensor neighborhood intake air amount) based on a transport delay that occurs until the intake air exerts an influence on the value of the air fuel ratio detected by the air fuel ratio sensor 15.

In addition, the fuel transport delay calculation section in the transport delay calculation section 25 calculates an amount of fuel in the neighborhood of the air fuel ratio sensor 15 (hereinafter referred to as an air fuel ratio sensor neighborhood fuel amount) based on a transport delay that occurs until the fuel supplied by the injector 12 exerts an influence on the value of the air fuel ratio detected by the air fuel ratio sensor 15.

The combustion chamber purge rate calculation section 26 calculates a purge rate in the combustion chamber (hereinafter referred to as a combustion chamber purge rate Rprgin) based on the combustion chamber purge flow rate and the combustion chamber intake air amount calculated by the transport delay calculation section 25.

The air fuel ratio sensor neighborhood purge rate calculation section 27 calculates a purge rate in the neighborhood of the air fuel ratio sensor 15 (hereinafter referred to as an air fuel ratio sensor neighborhood purge rate) Rprgex based on the air fuel ratio sensor neighborhood purge flow rate and the air fuel ratio sensor neighborhood intake air amount calculated by the transport delay calculation section 25.

The purge air concentration calculation section 28 calculates a purge air concentration Nprg based on the air fuel ratio sensor neighborhood purge rate Rprgex calculated by the air fuel ratio sensor neighborhood purge rate calculation section 27, the air fuel ratio sensor neighborhood intake air amount and the air fuel ratio sensor neighborhood fuel amount calculated by the transport delay calculation section 25, and the air fuel ratio detected by the air fuel ratio sensor 15 included in the various kinds of sensors 19.

The purge air concentration learning value calculation section 29 calculates a purge air concentration learning value Nprgf by applying averaging processing or filtering processing to the purge air concentration Nprg.

The fuel amount correction section 30 corrects an amount of fuel Qf to be supplied from the injector 12 to the internal combustion engine 13 based on the combustion chamber purge rate Rprgin calculated by the combustion chamber purge rate calculation section 26 and the purge air concentration learning value Nprgf calculated by the purge air concentration learning value calculation section 29.

The fuel amount correction section 30 clips the purge flow rate controlled by the purge flow control section 23 based on an upper limit value of a purge air concentration fuel correction coefficient Kprg (to be described later) (see a broken line arrow).

Here, note that the purge air concentration calculation section 28 calculates the purge air concentration Nprg when the air fuel ratio sensor neighborhood purge rate is larger than a first predetermined purge rate $\alpha$ (to be described later), and the fuel amount correction section 30 corrects the amount of fuel by clipping the purge flow control section 23 when the purge rate in the combustion chamber (hereinafter referred to as a combustion chamber purge rate) is larger than a second predetermined purge rate $\beta$ (to be described later).

The purge flow control section 23 controls the purge flow rate by using, as an upper limit value of the air fuel ratio sensor neighborhood purge rate Rprgex, a third predetermined purge rate larger than the second predetermined purge rate $\beta$ until the purge air concentration Nprg is first calculated after starting of the internal combustion engine 13.

The purge flow control section 23 holds or reduces the purge flow rate introduced into the intake system in case where the fuel correction amount calculated by the fuel amount correction section 30 is larger than or equal to a predetermined correction amount.

The purge flow control section 23 sets the rate of change of increase of the purge flow rate introduced into the intake system small in case where the purge air concentration Nprg is higher than a predetermined purge air concentration.

Further, when the purge air concentration learning value Nprgf is not updated over a predetermined period of time $\tau$ (to be described later), the purge air concentration learning value calculation section 29 clears the purge air concentration learning value Nprgf.

Figure 3:
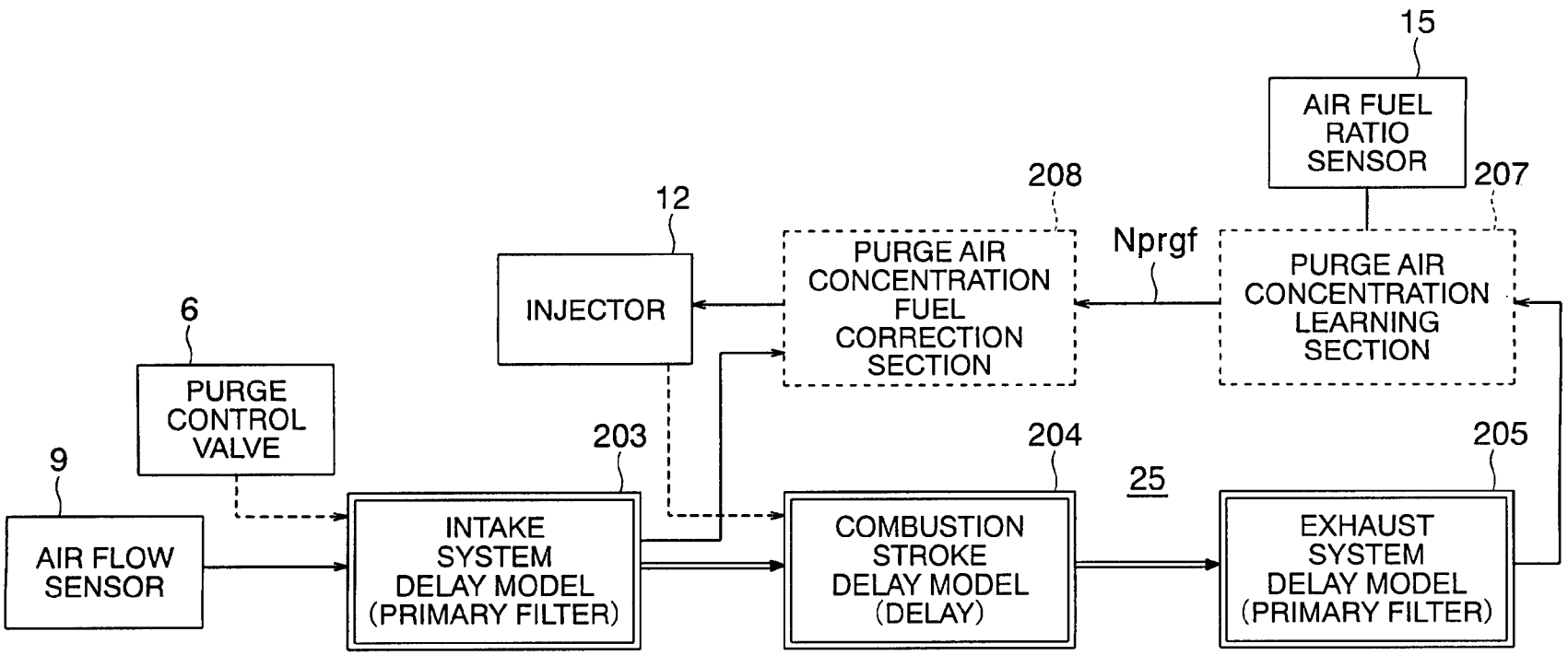
FIG. 3 is a block diagram showing the functional configuration of a transport delay calculation section together with its surrounding elements in FIG. 2.

FIG. 3 is a block diagram illustrating the functional configuration of the transport delay calculation section 25 in the ECU 20.

In FIG. 3, the transport delay calculation section 25 is provided with an intake system delay model 203 in the form of a primary filter, a combustion stroke delay model 204 in the form of a delay element, and an exhaust system delay model 205 in the form of a primary filter. A purge air concentration learning section 207 associated with the exhaust system delay model 205 corresponds to the purge air concentration calculation section 28 and the purge air concentration learning value calculation section 29 in FIG. 2, and calculates the purge air concentration learning value Nprgf. Also, a purge air concentration fuel correction section 208 associated with the intake system delay model 203 corresponds to the combustion chamber purge rate calculation section 26 and the correction amount calculation section 30 in FIG. 2, and calculates the purge air concentration fuel correction coefficient Kprg.

The individual functions of the intake system delay model 203, the combustion stroke delay model 204 and the exhaust system delay model 205 are included in the purge air transport delay calculation section, the intake air transport delay calculation section and the fuel transport delay calculation section in the transport delay calculation section 25, respectively. That is, the purge air transport delay calculation section and the intake air transport delay calculation section in the transport delay calculation section 25 respectively include the intake system delay model 203 that is modeled by using, as a first order delay element, a delay that occurs until the purge air and intake air supplied to the intake system arrive at the combustion chamber, the combustion stroke delay model 204 that is modeled by using a delay that occurs until the purge air and intake air, after having arrived at the combustion chamber, are exhausted to the exhaust system through strokes necessary for combustion thereof according to the strokes of the internal combustion engine 13, and the exhaust system delay model 205 that is modeled by using, as a first order delay element, a delay that occurs until the purge air and intake air, after having been exhausted to the exhaust system, are detected by the air fuel ratio sensor 15.

The fuel transport delay calculation section in the transport delay calculation section 25 includes the combustion stroke delay model 204 that is modeled by using a delay that occurs until the fuel supplied by the injector 12, after having arrived at the combustion chamber, is exhausted to the exhaust system through strokes necessary for combustion thereof according to the strokes of the internal combustion engine 13, and the exhaust system delay model 205 that is modeled by using, as a primary or first order delay element, a delay that occurs until the supplied fuel, after having been exhausted to the exhaust system, is detected by the air fuel ratio sensor 15. The individual delay models 203 through 205 are arranged in series with respect to one another, as shown in FIG. 3. In addition, the purge air concentration learning section 207 and the purge air concentration fuel correction section 208 are arranged in association with the intake system delay model 203 and the exhaust system delay model 205. The purge air concentration fuel correction section 208 contributes to driving correction of the injector 12.

The detected information (the amount of intake air) from the air flow sensor 9 is input to the intake system delay model 203, and the intake system delay model 203 is in association with the purge control valve 6. The calculation result of the intake system delay model 203 is input to the combustion stroke delay model 204, and contributes to the decision of the purge air concentration fuel correction coefficient Kprg in the purge air concentration fuel correction section 208.

The combustion stroke delay model 204 is in association with the injector 12, and the calculation result of the combustion stroke delay model 204 is input to the exhaust system delay model 205. The calculation result of the exhaust system delay model 205 contributes to the decision of the purge air concentration learning value Nprgf in the purge air concentration learning section 207. The detected value of the air fuel ratio by the air fuel ratio sensor 15 is used for the decision of the purge air concentration learning value Nprgf.

The air flow sensor 9 detects the flow rate of intake air at the upstream side of the throttle valve 8, and inputs to the intake system delay model 203. The purge control valve 6 is driven to operate, based on a basic target purge rate Rprgb (to be described later) and the purge air concentration fuel correction coefficient Kprg decided by the purge air concentration fuel correction section 208, in such a manner that the purge flow rate becomes the target purge flow rate Qprgt.

The intake system delay model 203 calculates the combustion chamber purge flow rate (value in consideration of a transport delay) and the combustion chamber intake air amount that actually flow into the combustion chamber by applying primary filtering processing to the intake air flow rate detected by the air flow sensor 9 and the target purge flow rate Qprgt calculated based on the engine operating condition. Here, note that in an initial state, when the calculation processing of the purge air concentration learning value Nprgf is not completed, the purge air concentration fuel correction coefficient Kprg has not been subjected to fuel correction and remains in an initial value. Accordingly, in this case, an amount of fuel Qf, which is decided based on the set target air fuel ratio and the detected amount of intake air, is injected from the injector 12.

The combustion stroke delay model 204 applies delay processing of a predetermined period (e.g., a period corresponding to four strokes in case of an ordinary four stroke engine) to the combustion chamber intake air amount and the combustion chamber purge flow rate calculated by the intake system delay model 203, and to the amount of fuel injected from the injector 12.

Subsequently, the exhaust system delay model 205 performs primary filtering processing, and finally calculates the air fuel ratio sensor neighborhood intake air flow rate, the air fuel ratio sensor neighborhood purge flow rate, and the air fuel ratio sensor neighborhood fuel amount that correspond to the values of the intake air flow rate, the purge flow rate and the fuel amount, respectively, in the neighborhood of the air fuel ratio sensor 15.

However, in case where air fuel ratio feedback control is carried out so as to achieve the target air fuel ratio at the time of closure of the purge control valve 6, the detected value of the air fuel ratio sensor 15 should be substantially in coincidence with the target air fuel ratio. In addition, though the integral term of the air fuel ratio feedback correction coefficient at this time might be shifted or deviated from a median value due to a variation of the air flow sensor 9 and/or the injector 12, such an amount of shift or deviation is generally stored as an air fuel ratio learning value, and by performing such air fuel ratio learning processing, air fuel ratio feedback control is carried out so that the integral term of the air fuel ratio feedback correction coefficient is made to be the median value.

Next, reference will be made to an operation of the control apparatus for an internal combustion engine according to the first embodiment while referring to FIGS. 1 through 3.

When the injector 12 is controlled based on the detection results of the air flow sensor 9 and the air fuel ratio sensor 15, the output of the air fuel ratio sensor 15 will be swung or shifted to a lean side or a rich side upon introduction of purge air whose air fuel ratio is unknown, except where the air fuel ratio of the purge air coincides with the target air fuel ratio. Organizing the physical phenomenon that happens here, it is clear that the amount of swing or shift of the air fuel ratio sensor 15 depends on the air fuel ratio sensor neighborhood intake air flow rate, the air fuel ratio sensor neighborhood purge flow rate, the air fuel ratio sensor neighborhood fuel amount, and the purge air concentration Nprg (the air fuel ratio of purge air). Accordingly, the purge air concentration Nprg, which is an unknown value, can be calculated based on the air fuel ratio sensor neighborhood intake air flow rate, the air fuel ratio sensor neighborhood purge flow rate and the air fuel ratio sensor neighborhood fuel amount calculated by the transport delay calculation section 25, and the detected value of the air fuel ratio sensor 15 (or the amount of deviation from the median value of the integral term of the air fuel ratio feedback correction coefficient). A specific method for calculating the purge air concentration Nprg will be described later.

When the purge air concentration Nprg is calculated in this manner, it is considered that the actual change speed of purge air concentration is sufficiently slow in comparison with the stroke period of the internal combustion engine 13, so the purge air concentration Nprg should be substantially the same value even if the operating condition of the internal combustion engine 13 changes. However, in actuality, some error is expected to be contained in the purge air concentration Nprg due to the variation of the air flow sensor 9, the injector 12 or the air fuel ratio sensor 15, and/or due to the air fuel ratio feedback control period, etc. Accordingly, in the first embodiment of the present invention, in order to absorb the error that might be contained in the purge air concentration Nprg, the purge air concentration Nprg calculated in each engine stroke is averaged and further smoothed by applying thereto filtering processing, as shown in FIG. 3, whereby it is handled as the purge air concentration learning value Nprgf.

In case where the purge air supplied from the purge control valve 6 flows into the combustion chamber, if the purge air concentration learning value Nprgf is calculated, as shown in FIG. 3, it is possible to correct the amount of fuel so that there takes place no deviation or variation in the air fuel ratio detected by the air fuel ratio sensor 15 due to the purge air. In other words, based on the purge air concentration learning value Nprgf and the amount of intake air and the purge flow rate after processing according to the intake system delay model 203, the amount of deviation of the integral term (the value that is controlled to the median value if purge air is not introduced) of the air fuel ratio feedback correction coefficient (the value that is predicted to generate due to the introduction of purge air) is calculated as the purge air concentration fuel correction coefficient Kprg.

Hereinafter, by correcting the amount of fuel Qf supplied from the injector 12 by the use of the purge air concentration fuel correction coefficient Kprg, the purge air concentration fuel correction coefficient Kprg is calculated in an appropriate manner, and hence the air fuel ratio can be controlled to the target value even when the amount of purge air introduced or the amount of intake air changes with the air fuel ratio feedback correction coefficient being kept controlled to the median value.

Thus, physical values at an appropriate time point among those calculated by the intake system delay model 203, the combustion stroke delay model 204 and the exhaust system delay model 205 can be used as physical values necessary for calculation of the purge air concentration Nprg and physical values necessary for calculation of the purge air concentration fuel correction coefficient Kprg that corrects the amount of fuel supplied from the injector 12.

Now, a control processing operation according to the first embodiment of the present invention will be explained in further detail while referring to FIGS. 1 through 3 together with flow charts in FIGS. 4 through 7.

Reference will first be made to the calculation processing of the target purge rate Rprgt by the target purge rate calculation section 21 and the calculation processing of the target purge flow rate Qprgt by the target purge flow rate calculation section 22 while referring to FIG. 4.

Figure 4:
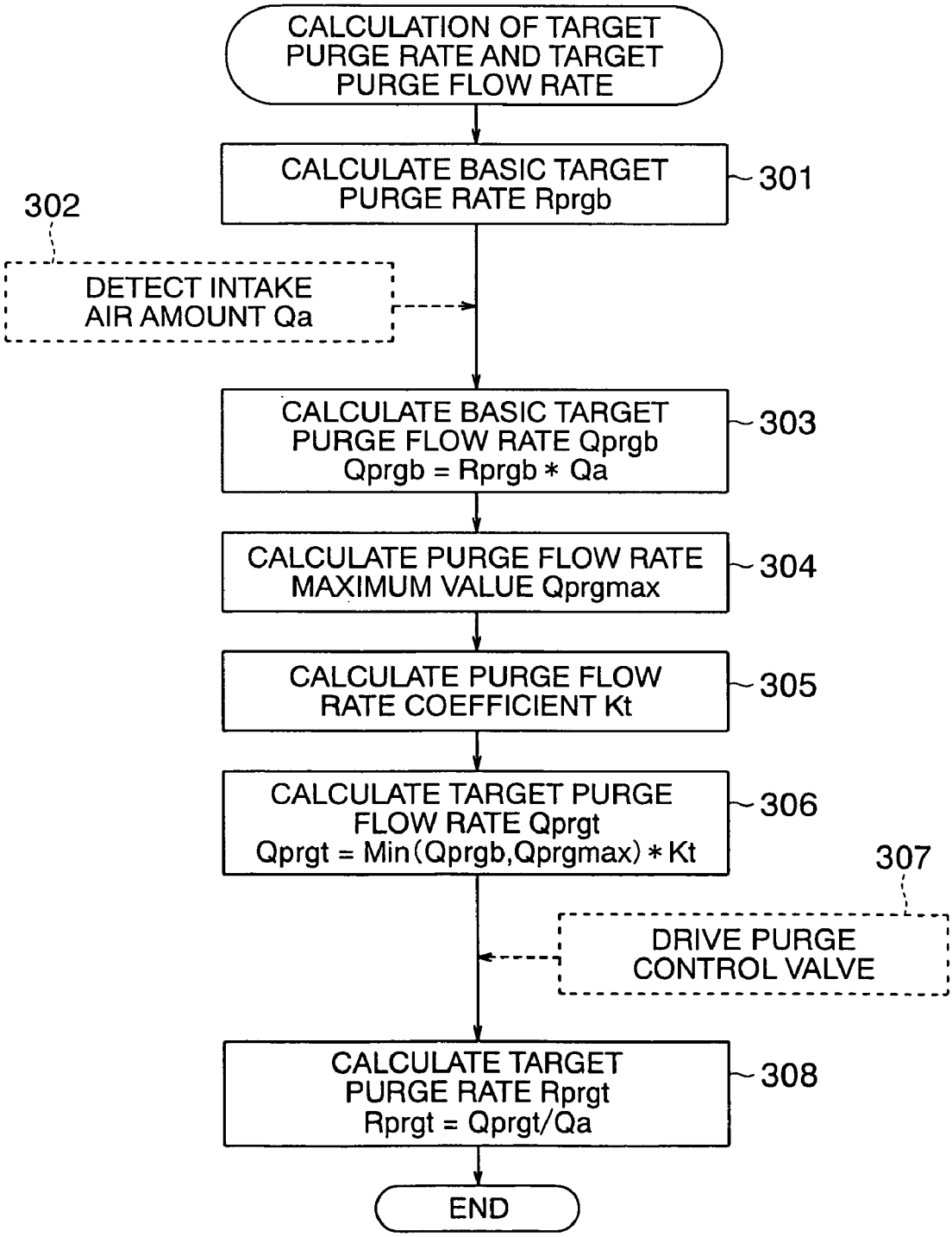
FIG. 4 is a flow chart illustrating a processing routine to calculate a target purge rate and a target purge flow rate according to the first embodiment of the present invention.

In FIG. 4, first of all, the target purge rate calculation section 21 calculates the basic target purge rate Rprgb which becomes the target purge rate (step 301). Specifically, the basic target purge rate Rprgb is calculated based on the engine operating condition detected by the various kinds of sensors 19 (operating condition detection section). For example, there is a method of calculation in which basic target purge rates Rprgb for individual conditions such as at the time of idling, non-idling, acceleration and deceleration, high load operation, etc., are stored as map data in the ROM of the digital computer in the ECU 20, and an appropriate basic target purge rate is read out in accordance with the engine operating condition.

In addition, there is also another method of calculation in which a table in the form of a control map with orthogonal axes being represented by parameters (e.g., the number of revolutions per minute of the internal combustion engine 13, the charging efficiency or the internal pressure in the surge tank 7) that indicate the engine operating condition is prepared, and basic target purge rates are stored in this control map, so that a basic target purge rate Rprgb can be read out in accordance with the engine operating condition.

Subsequently, the target purge flow rate calculation section 22 detects the amount of intake air Qa according to a subroutine (not shown) for detecting the operating condition of the internal combustion engine 13 (step 302), and calculates a basic target purge flow rate Qprgb by using the detected amount of intake air Qa and the basic target purge rate Rprgb, as shown in the following expression (1) (step 303).

$$Qprgb=Rprgb*Qa \quad (1)$$

However, in case where a flow control method according to duty control is applied as a general configuration example to the purge control valve 6, the flow generated by a pressure difference between the pressure in the atmospheric opening 3*a* of the canister 3 (i.e., atmospheric pressure) and the negative pressure generated in the surge tank 7 is controlled by the on/off ratio of an electromagnetic valve portion of the purge control valve 6. When the purge control valve 6 of the duty control type is used, the maximum value of the flow rate corresponds to a state in which the turned-on state of the purge control valve 6 continues (i.e., the state of duty=100%), and it is decided by a pressure difference between atmospheric pressure and the negative pressure in the surge tank 7, so it is theoretically impossible to achieve a flow rate higher than that decided by such a pressure difference.

Accordingly, subsequent to step 303, the target purge flow rate calculation section 22 calculates the purge flow rate maximum value Qprgmax (step 304). Here, note that as a specific method for calculating the purge flow rate maximum value Qprgmax, the purge flow rate maximum value Qprgmax of the purge control valve 6 to be calculated is stored in a control map in which the pressure difference between the atmospheric pressure and the negative pressure in the surge tank 7 is represented on an axis, and is read out therefrom in accordance with the environmental condition and the engine operating condition.

Subsequently, the target purge flow rate calculation section 22 calculates a purge flow rate coefficient Kt as a coefficient to prevent the drive feeling from being deteriorated by a sudden change of the purge flow rate (step 305).

Here, note that the purge flow rate coefficient Kt also functions as a coefficient to limit the purge flow rate. This is because during the time until the purge air concentration Nprg has been calculated, the purge air concentration is generally uncertain, so it is supposed that the exhaust gas might be deteriorated due to the introduction of a large amount of purge air, so it is necessary to suppress the purge air to be introduced to a relatively small amount. In addition, the purge flow rate coefficient Kt is a coefficient to hold or reduce the purge flow rate, or to limit the purge flow rate to a predetermined value. This is because when the purge air concentration fuel correction coefficient Kprg becomes large in a state where the purge air concentration Nprg is high and the amount of introduction of purge air is large (to be described later), there is a possibility that an error in the purge air concentration fuel correction coefficient Kprg cannot be suppressed even with the application of the present invention, as a result of which it is considered that the exhaust gas might be deteriorated. Further, the purge flow rate coefficient Kt also is a coefficient to prevent the purge flow rate from changing suddenly. This is because when the purge flow rate changes for example at a speed close to (or equal to or higher than) the response speed of air fuel ratio feedback control in a state where the purge air concentration Nprg is high, there is a possibility that a phase shift or deviation occurs even with the application of the present invention, as a result of which it is considered that the exhaust gas might be deteriorated.

Here, reference will be made to one example of the method of calculating the purge flow rate coefficient Kt. For example, the purge flow rate coefficient Kt is defined such that it can be variably set within the range of "0" through "1", in which purge control is stopped when "Kt=0", whereas purge air is controlled to the basic target purge flow rate Qprgb when "Kt=1". The purge flow rate coefficient Kt operates as follows. That is, when the introduction of purge air is permitted, the purge flow rate coefficient Kt is added by a predetermined value at every predetermined sampling time, whereas when the introduction of purge air is inhibited, the purge flow rate coefficient Kt is subtracted by the predetermined value at every predetermined sampling time. In addition, during the time until the purge air concentration Nprg has been calculated, or when the purge air concentration fuel correction coefficient Kprg becomes large, an upper limit value is set for the purge flow rate coefficient Kt, so that the purge flow rate can be limited by clipping the purge flow rate coefficient Kt to the upper limit value.

Then, subsequent to step 305, the target purge flow rate calculation section 22 calculates a final target purge flow rate Qprgt based on the basic target purge flow rate Qprgb, the purge flow rate maximum value Qprgmax and the purge flow rate coefficient Kt, as shown by the following expression (2) (step 306).

$$Qprgt=\mathrm{Min}(Qprgb,\ Qprg\mathrm{max})*Kt \tag{2}$$

where Min(Qprgb, Qprgmax) indicates that the smaller one of the basic target purge flow rate Qprgb and the purge flow rate maximum value Qprgmax is selected.

The calculated target purge flow rate Qprgt is used for a subroutine (not shown) to drive the purge control valve 6 in the purge flow rate control section 23 (step 307). In step 307, the purge control valve 6 is controlled in such a manner that the purge flow rate becomes the target purge flow rate Qprgt. As a method for performing flow rate control by means of the purge control valve 6, there is adopted a method using duty control, or a method of storing duty ratios capable of achieving target flow rates, respectively, in the control map (e.g., a map comprising the pressure difference between the atmospheric pressure and the negative pressure in the surge tank 7 and the flow rate of the purge control valve 6), and reading out an appropriate duty ratio from the map in accordance with the environmental condition, the engine operating condition and the target purge flow rate Qprgt.

Finally, the target purge rate calculation section 21 calculates a finally achieved purge rate as a target purge rate Rprgt by using the target purge flow rate Qprgt and the amount of intake air Qa, as shown by the following expression (3) (step 308), and the processing routine of FIG. 4 is terminated.

$$Rprgt=Qprgt/Qa \tag{3}$$

As described above, the target purge rate Rprgt and the target purge flow rate Qprgt are calculated in the target purge rate calculation section 21 and the target purge flow rate calculation section 22, respectively.

Next, reference will be made to the processing of calculating the transport delays of purge air, intake air and fuel according to the transport delay calculation section 25 in association with the calculation processing of the combustion chamber purge rate calculation section 26 and the air fuel ratio sensor neighborhood purge rate calculation section 27 while referring to FIG. 5.

Figure 5:
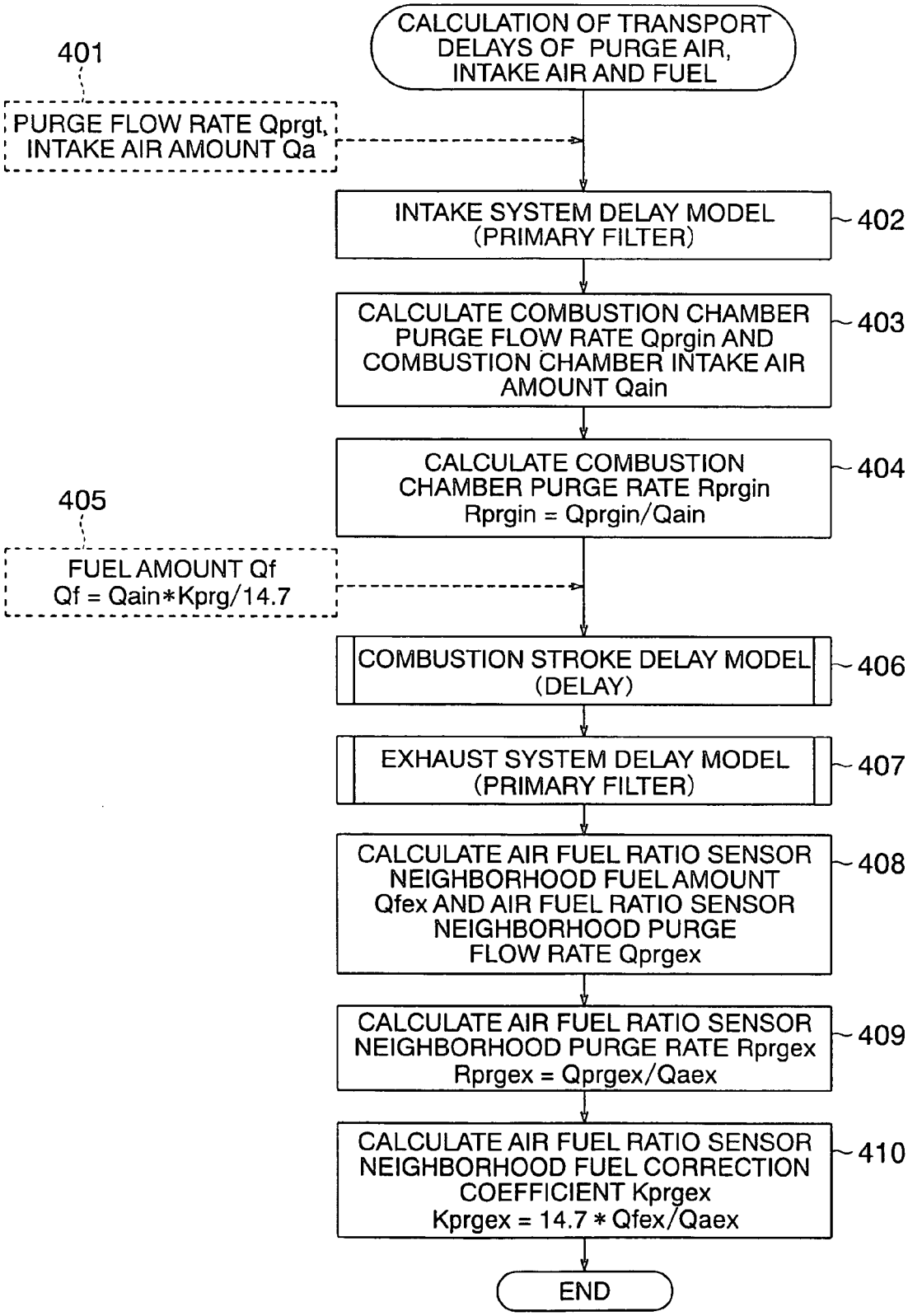
FIG. 5 is a flow chart illustrating a processing routine to calculate the transport delays of purge air, intake air, and fuel according to the first embodiment of the present invention.

In FIG. 5, the transport delay calculation section 25 first executes the processing of the intake system delay model 203 (primary filter) based on the target purge flow rate Qprgt and the amount of intake air Qa (step 401) calculated according to the above-mentioned processing routine (FIG. 3) (step 402).

In step 402, the target purge rate Rprgt calculated in the above-mentioned processing routine (FIG. 4) is used by being read as an actual purge flow rate, and the amount of intake air Qa detected in an operating condition detection routine (not shown) for the internal combustion engine 13 is used. Also, in step 402, the intake system delay model 203 simulates the response delay of the intake system of the internal combustion engine 13 by using a primary filter (i.e., handling the intake system delay model 203 as a primary or first order delay element).

In general, when the primary filter is applied to the digital computer in the ECU 20, such a simulation can be done by using a digital primary filter, as shown by the following expression (4).

$$\begin{aligned} Qain(n) &= K*Qain(n-1)+(1-K)*Qa(n)\ Qprgin(n) \\ &= K*Qprgin(n-1)+(1-K)*Qprgt(n) \end{aligned} \tag{4}$$

where K is a filter constant which is generally of a value of 0.9 or therearound; Qa(n) is the amount of the intake air that is detected by the air flow sensor 9 during the nth stroke; Qain(n) is the amount of the intake air that is introduced into the combustion chamber of the internal combustion engine 13 during the nth stroke; Qain (n−1) is the amount of the intake air that is introduced into the combustion chamber of the internal combustion engine 13 during the (n−1)th stroke; Qprgt(n) is the flow rate of the purge air that is introduced from the purge control valve 6 during the nth stroke; Qprgin(n) is the flow rate of the purge air that is introduced into the combustion chamber of the internal combustion engine 13 during the nth stroke; and Qprgin(n−1) is the flow rate of the purge air that is introduced into the combustion chamber of the internal combustion engine 13 during the (n−1)th stroke.

Here, note that the intake system delay model 203 executes the calculation processing of expression (4) at each stroke of the internal combustion engine 13 in step 402. As the calculation result in step 402, the combustion chamber purge flow rate Qprgin and the combustion chamber intake air amount Qain in the combustion chamber of the internal combustion engine 13 are calculated (step 403).

Subsequently, the combustion chamber purge rate calculation section 26 calculates the combustion chamber purge rate Rprgin (actual purge rate) by using the individual calculation values Qprgin, Qain in the combustion chamber (step 404).

Thereafter, the combustion stroke delay model 204 executes delay processing on the combustion chamber purge flow rate Qprgin, the combustion chamber intake air amount Qain and the amount of fuel Of by using the amount of fuel Of (step 405) calculated in another subroutine (step 406).

Here, note that the amount of fuel Of is generally calculated according to the following expression (5) by using the combustion chamber intake air amount Qain, the target air fuel ratio (e.g., the stoichiometric air fuel ratio of 14.7) and the purge air concentration fuel correction coefficient Kprg.

$$Qf=Qain*Kprg/14.7 \tag{5}$$

However, note that in expression (5) above, correction values (e.g., an air fuel ratio correction coefficient, a warm-up correction coefficient, a startup correction coefficient, a post-startup correction coefficient, an air fuel ratio feedback correction coefficient, etc.) other than the purge air concentration fuel correction coefficient Kprg are not described so as to avoid complexity.

In the delay processing (step 406) of the combustion stroke delay model 204, a delay time is generally set to a time corresponding to four strokes in case of a four-stroke engine.

Subsequently, similar to the case of the intake system delay model 203, the exhaust system delay model 205 is handled as a primary delay element, and specifically by using a primary filter, the response delay of the exhaust system of the internal combustion engine 13 is simulated (step 407).

In case where the primary filter is applied to the digital computer in the ECU 20, such a simulation can generally be achieved by using a digital primary filter, as shown by the following expression (6).

$$\begin{aligned} Qaex(n) &= K * Qaex(n-1) + (1-K) * Qain(n-4)\ Qprgex(n) \\ &= K * Qprgex(n-1) + (1-K) * Qprgin(n-4)\ Qfex(n) \\ &= K * Qfex(n-1) + (1-K) * Qfin(n-4) \end{aligned} \quad (6)$$

where K is a filter constant, similar to K in above-mentioned expression (4), which is generally of a value of 0.9 or therearound; Qaex(n) is the flow rate of the intake air that arrives at the neighborhood of the air fuel ratio sensor 15 and is detected by the air fuel ratio sensor 15 during the nth stroke; Qaex (n−1) is the flow rate of the intake air that arrives at the neighborhood of the air fuel ratio sensor 15 and is detected by the air fuel ratio sensor 15 during the (n−1)th stroke; and Qain (n−4) is the amount of the intake air that is introduced into the combustion chamber of the internal combustion engine 13 during the (n−4)th stroke.

Since the amount of intake air Qain(n−4) sucked into the combustion chamber during the (n−4)th stroke is used, the delay processing (step 406) according to the combustion stroke delay model 204 can also be carried out or calculated according to expression (6) by executing the calculation processing of expression (6) at each stroke of the internal combustion engine 13.

In addition, in expression (6), Qprgex(n) is the flow rate of the purge air that arrives at the neighborhood of the air fuel ratio sensor 15 and is detected by the air fuel ratio sensor 15 during the nth stroke; Qprgex(n−1) is the flow rate of the purge air that arrives at the neighborhood of the air fuel ratio sensor 15 and is detected by the air fuel ratio sensor 15 during the (n−1)th stroke; Qprgin(n−4) is the flow rate of the purge air that is introduced into the combustion chamber of the internal combustion engine 13 during the (n−4)th stroke; Qfex(n) is the amount of the fuel that arrives at the neighborhood of the air fuel ratio sensor 15 and is detected by the air fuel ratio sensor 15 during the nth stroke; Qfex (n−1) is the amount of the fuel that arrives at the neighborhood of the air fuel ratio sensor 15 and is detected by the air fuel ratio sensor 15 during the (n−1)th stroke; and Qfin (n−4) is the amount of the fuel that is introduced into the combustion chamber of the internal combustion engine 13 during the (n−4)th stroke.

Subsequently, the purge flow rate Qprgex, the amount of intake air Qaex and the amount of fuel Qfex corresponding to those in the neighborhood of the air fuel ratio sensor 15 are calculated as the calculation result of the calculation processing (steps 406, 407) according to the combustion stroke delay model 204 and the exhaust system delay model 205 (step 408). Then, the air fuel ratio sensor neighborhood purge rate Rprgex is calculated by using the calculation result (Qprgex, Qaex, and Qfex) corresponding to the values in the neighborhood of air fuel ratio sensor 15 (step 409). Further, a fuel correction coefficient Kprgex in the neighborhood of the air fuel ratio sensor 15 (hereinafter referred to as an air fuel ratio sensor neighborhood fuel correction coefficient) is calculated (step 410), and the processing routine of FIG. 5 is terminated. Here, note that the air fuel ratio sensor neighborhood fuel correction coefficient Kprgex is an air fuel ratio sensor neighborhood corresponding value of the purge air concentration fuel correction coefficient Kprg in expression (5) in step 405.

Next, reference will be made to the calculation processing of the purge air concentration Nprg according to the purge air concentration calculation section 28 and the calculation processing of the purge air concentration learning value Nprgf according to the purge air concentration learning value calculation section 29 while referring to FIG. 6.

Figure 6:
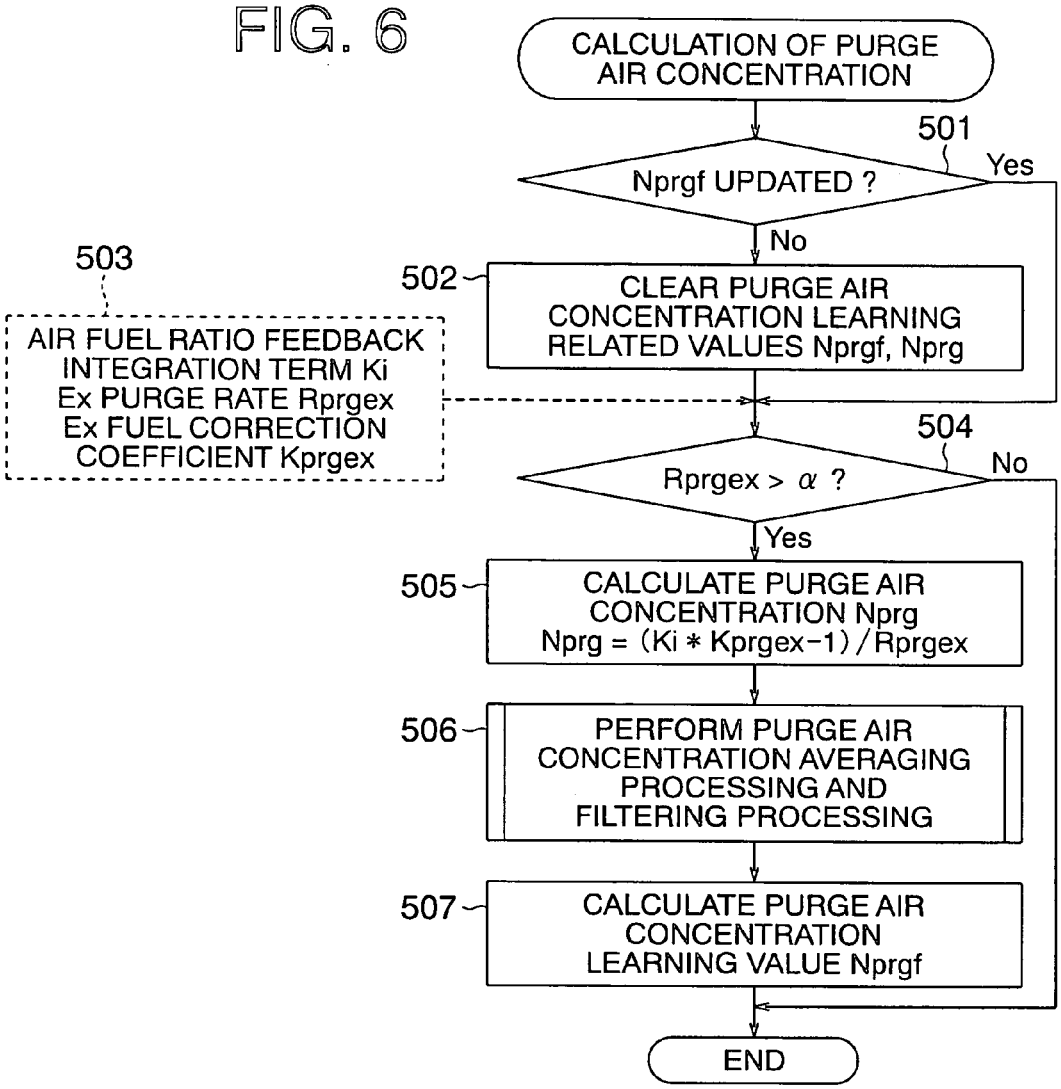
FIG. 6 is a flow chart illustrating a processing routine calculate of the concentration of purge air according to the first embodiment of the present invention.

In FIG. 6, first of all, it is determined whether the purge air concentration learning value Nprgf has been updated within a predetermined time τ (step 501), and when it is determined that the purge air concentration learning value Nprgf has not been updated (that is, No), the processing of clearing the values associated with purge air concentration learning (the purge air concentration learning value Nprgf and the purge air concentration Nprg) is carried out (step 502), and the control flow proceeds to step 504. On the other hand, when it is determined in step 501 that the purge air concentration learning value Nprgf has been updated within the predetermined time τ (that is, Yes), the control flow proceeds to step 504 at once.

In step 504, referring to the air fuel ratio sensor neighborhood purge rate Rprgex (step 503) calculated in the above-mentioned processing routine (FIG. 5), it is determined whether the air fuel ratio sensor neighborhood purge rate Rprgex is larger than the predetermined purge rate α (step 504). When it is determined as Rprgex≦α in step 504 (that is, No), the processing routine of FIG. 6 is terminated at once, whereas when it is determined as Rprgex>α in step 504 (that is, Yes), the purge air concentration Nprg is calculated according to the following expression (7) by using an integral term Ki of the air fuel ratio feedback correction coefficient, the air fuel ratio sensor neighborhood purge rate Rprgex and the air fuel ratio sensor neighborhood fuel correction coefficient Kprgex (step 503) calculated in other subroutines (step 505).

$$Nprg=(Ki*Kprgex-1)/Rprgex \quad (7)$$

The purge air concentration Nprg calculated according to expression (7) is a value that is to be called an instantaneous value, and as stated above, the change speed or rate of the purge air concentration Nprg can be considered to be sufficiently slow as compared with the stroke period of the internal combustion engine 13.

Subsequently, in order to absorb the variation of the air flow sensor 9, the injector 12 or the air fuel ratio sensor 15 and/or an error due to the air fuel ratio feedback control period, the purge air concentration learning value calculation section 29 averages the purge air concentration Nprg calculated at each stroke, and further performs filtering processing thereon thereby to smooth the purge air concentration Nprg (step 506).

As a result, the final purge air concentration learning value Nprgf is calculated (step 507), and the processing routine of FIG. 6 is terminated.

Next, reference will be made to the calculation processing of the purge air concentration fuel correction coefficient Kprg according to the fuel amount correction section 30 while referring to FIG. 7.

Figure 7:
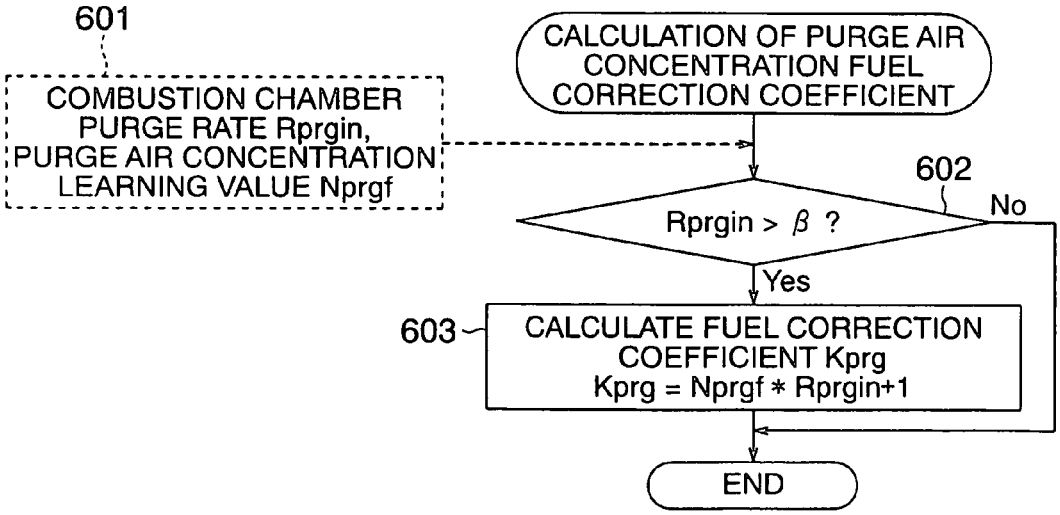
FIG. 7 is a flow chart illustrating a processing routine to calculate a purge air concentration fuel correction coefficient according to the first embodiment of the present invention.

In FIG. 7, first of all, referring to the combustion chamber purge rate Rprgin (step 601) calculated in the above-mentioned subroutine (FIG. 5), it is determined whether the combustion chamber purge rate Rprgin is larger than the predetermined purge rate β (step 602). When it is determined as Rprgin≦β in step 602 (that is, No), the processing routine of FIG. 7 is terminated at once, whereas when it is determined as Rprgin>β in step 602 (that is, Yes), the purge air concentration fuel correction coefficient Kprg is calculated according to the following expression (8) by using the combustion chamber purge rate Rprgin and the purge air concentration learning value Nprgf calculated in the above-mentioned subroutines (FIGS. 5 and 6) (step 603), and the processing routine of FIG. 7 is terminated.

$$Kprg=Nprgf*Rprgin+1 \quad (7)$$

Hereinafter, the fuel amount correction section 30 corrects the amount of fuel Of injected from the injector 12 into the internal combustion engine 13 based on the purge air concentration fuel correction coefficient Kprg, and clips and corrects the purge flow rate controlled by the purge flow control section 23 based on the upper limit value of the purge air concentration fuel correction coefficient Kprg.

Now, reference will be made to the control operation of the evaporated fuel treatment device according to the first embodiment of the present invention while referring to a timing chart of FIG. 8.

Figure 8:
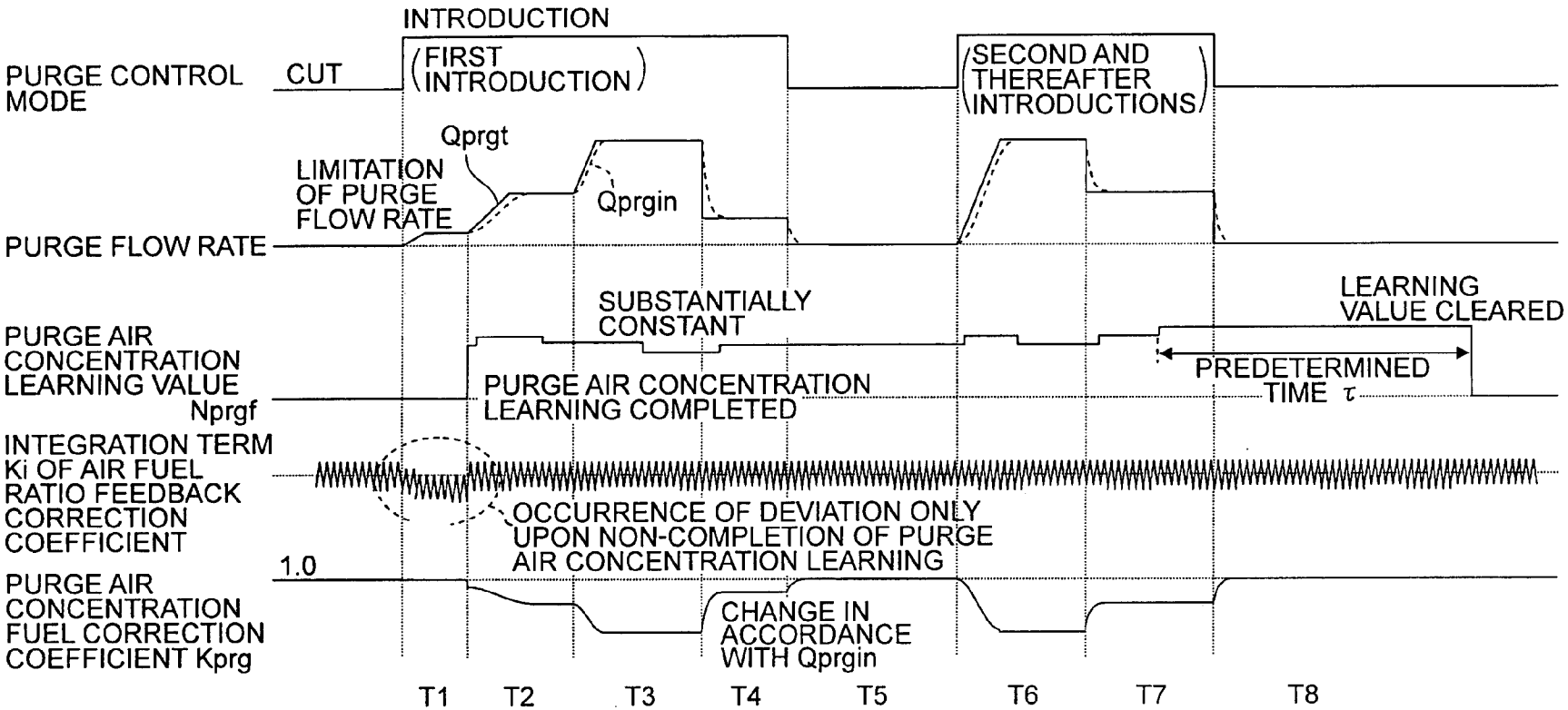
FIG. 8 is a timing chart illustrating a specific operation sequence according to the first embodiment of the present invention.

In FIG. 8, there are schematically illustrated the behaviors of the evaporated fuel treatment device in individual timing periods T1 through T8 when purge air is introduced under a certain operating condition with the purge flow rate being changed in accordance with the change of the engine operating condition.

Also, in FIG. 8, there are illustrated, sequentially from top to bottom, the individual behaviors of a purge control mode, the purge flow rate, the purge air concentration learning value Nprgf, the integral term Ki of the air fuel ratio F/B (feedback) correction coefficient, and the purge air concentration fuel correction coefficient Kprg.

In FIG. 8, the purge control mode indicates the condition of introduction (or cut) of purge air, and purge air is introduced into the combustion chamber only when the introduction condition holds. Also, in FIG. 8, the individual behaviors of the target purge flow rate Qprgt (see a solid line) and the air fuel ratio sensor neighborhood purge flow rate Qprgex (see a broken line) during introduction of purge air are shown as purge flow rates. After purge air concentration learning processing is completed, the purge air concentration learning value Nprgf is maintained at a substantially constant or fixed value. In addition, as shown in FIG. 8, there occurs a deviation in the integral term Ki of the air fuel ratio feedback correction coefficient in a period of time from the permission of introduction of purge air to the completion of the purge air concentration learning processing. The purge air concentration fuel correction coefficient Kprg changes in accordance with the combustion chamber purge rate Rprgin and the purge air concentration learning value Nprgf.

Hereinafter, a specific explanation will be made following the time sequence of individual timing periods T1 through T8.

First of all, when purge control is started at a first timing T1, the purge flow rate increases gradually. At this time, if purge air concentration learning is not completed, the purge flow rate is limited by a predetermined value. In addition, if purge air concentration learning is not completed, an amount of deviation (see a broken line frame) occurs in the integral term Ki of the air fuel ratio feedback correction coefficient, for example, in the timing period T1 during purge control. At this time, the purge air concentration calculation section 28 calculates the purge air concentration Nprg based on the amount of deviation of the integral term Ki and the air fuel ratio sensor neighborhood purge rate Rprgex, and the purge air concentration learning value calculation section 29 calculates the purge air concentration learning value Nprgf by applying filtering processing, etc., to the purge air concentration Nprg.

Then, in a timing period T2, the calculation processing of the learning value Nprgf of the purge air concentration Nprg is completed, and the integral term Ki of the air fuel ratio feedback correction coefficient is restored to the median value. That is, the purge air concentration fuel correction coefficient Kprg is automatically calculated from the combustion chamber purge rate Rprgin and the purge air concentration learning value Nprgf.

Subsequently, in timing periods T2 through T4, the target purge flow rate Qprgt is properly changed in accordance with the operating condition of the internal combustion engine 13. Also, as the combustion chamber purge flow rate Qprgin, there is employed a value that is obtained by applying filtering processing to the target purge flow rate Qprgt.

The following timing period T5 indicates a period in which purge air is cut, and the purge air concentration learning value Nprgf continues to be stored when purge air is cut. In the following timing period T6, purge air is introduced again but not limited by the predetermined value, unlike the introduction of purge air in the first timing period T1, so control is carried out with the target purge flow rate Qprgt from the start of purge air introduction. This is because the calculation processing of the purge air concentration learning value Nprgf has already been completed, and control can be made with the use of the purge air concentration learning value Nprgf.

Thereafter, in a timing period T7, the target purge flow rate Qprgt is changed in accordance with the engine operating condition, as in the above-mentioned timing periods T2 through T4. Finally, in a timing period T8, at the time when the predetermined time τ has elapsed after the start of purge air cutting, the purge air concentration learning value Nprgf is cleared.

As a result, when the concentration of evaporated fuel in the canister 3 changes during purge cut, it is possible to prevent an error from occurring between the actual purge air concentration and the purge air concentration learning value Nprgf stored in the purge air concentration learning value calculation section 29, whereby the occurrence of an error in the purge air concentration fuel correction coefficient Kprg can be avoided upon re-introduction of purge air.

As described above, the control apparatus for an internal combustion engine according to the first embodiment of the present invention comprises: the purge passage 5 that connects between the canister 3 and the intake system of the internal combustion engine 13; the purge control valve 6 that is arranged in the purge passage 5 for controlling the purge flow rate; the injector 12 that is arranged in the neighborhood of the intake port of the internal combustion engine 13 or in the combustion chamber for supplying fuel to the internal combustion engine 13; the air fuel ratio sensor 15 that is arranged in the exhaust system of the internal combustion engine 13 for detecting the air fuel ratio of the exhaust gas; the target purge rate calculation section 21 that calculates the target purge rate Rprgt based on the operating condition of the internal combustion engine 13; the target purge flow rate calculation section 22 that calculates the target purge flow rate Qprgt based on the engine operating condition and the target purge rate Rprgt; the purge flow rate control section 23 that controls the purge control valve 6 so as to achieve the target purge flow rate Qprgt; and the air fuel ratio feedback control section 24 in the ECU 20 for controlling the amount of fuel supplied from the injector 12 in a feedback manner such that the air fuel ratio becomes the target air fuel ratio.

The transport delay calculation section 25 in the ECU 20 includes: the purge air transport delay calculation section that calculates a transport delay of purge air until the purge air supplied to the intake system through the purge control valve 6 reaches the combustion chamber, and also calculates a transport delay of purge air until the purge air influences the detected value of the air fuel ratio sensor 15 in the exhaust system; the intake air transport delay calculation section that calculates a transport delay of intake air until the intake air detected by the air flow sensor 9 reaches the combustion chamber, and also calculates a transport delay of intake air until the intake air influences the detected value of the air fuel ratio sensor 15 in the exhaust system; and the fuel transport delay calculation section that calculates a transport delay of fuel until the fuel supplied from the injector 12 influences the detected value of the air fuel ratio sensor 15 in the exhaust system.

Further, the ECU 20 includes: the combustion chamber purge rate calculation section 26 that calculates the combustion chamber purge rate Rprgin based on the combustion chamber purge flow rate Qprgin and the combustion chamber intake air amount Qain calculated by the purge air transport delay calculation section and the intake air transport delay calculation section, respectively, in the transport delay calculation section 25; the air fuel ratio sensor neighborhood purge rate calculation section 27 that similarly calculates the air fuel ratio sensor neighborhood purge rate Rprgex based on the air fuel ratio sensor neighborhood purge flow rate Qprgex and the air fuel ratio sensor neighborhood intake air amount Qaex calculated in the transport delay calculation section 25; the purge air concentration calculation section 28 that calculates the purge air concentration Nprg based on the air fuel ratio sensor neighborhood purge rate Rprgex, the air fuel ratio sensor neighborhood intake air amount Qaex, the air fuel ratio sensor neighborhood fuel amount Qfex and the detected value of the air fuel ratio; the purge air concentration learning value calculation section 29 that calculates the purge air concentration learning value Nprgf by smoothing the purge air concentration Nprg; and the fuel amount correction section 30 that corrects the amount of fuel supplied to the internal combustion engine 13 based on the combustion chamber purge rate Rprgin and the purge air concentration learning value Nprgf.

Specifically, the transport delay calculation section 25 and the purge air concentration calculation section 28 calculate the purge air concentration Nprg in consideration of the transport delays of the purge air, the intake air and the fuel introduced into the internal combustion engine 13, and the fuel amount correction section 30 calculates the purge air concentration fuel correction coefficient Kprg and corrects the amount of driving of the injector 12. As a result, even if transient operation is performed in the internal combustion engine 13, or even if the purge flow rate is changed, the variation of the air fuel ratio can be suppressed.

In addition, the purge air transport delay calculation section and the intake air transport delay calculation section in the transport delay calculation section 25 are configured to use the intake system delay model 203 that is modeled by using, as a primary or first order delay element, a delay that occurs until the purge air and intake air supplied to the intake system arrive at the combustion chamber, the combustion stroke delay model 204 that is modeled by using a delay that occurs until the purge air and intake air, after having arrived at the combustion chamber, are exhausted to the exhaust system through strokes necessary for combustion thereof according to the strokes of the internal combustion engine 13, and the exhaust system delay model 205 that is modeled by using, as a primary or first order delay element, a delay that occurs until the purge air and intake air, after having been exhausted to the exhaust system, are detected by the air fuel ratio sensor 15.

Moreover, the fuel transport delay calculation section in the transport delay calculation section 25 is configured to use the combustion stroke delay model 204 that is modeled by using a delay that occurs until the fuel supplied from the injector 12, after having arrived at the combustion chamber, is exhausted to the exhaust system through strokes necessary for combustion thereof according to the strokes of the internal combustion engine 13, and the exhaust system delay model 205 that is modeled by using, as a primary or first order delay element, a delay that occurs until the supplied fuel, after having been exhausted to the exhaust system, is detected by the air fuel ratio sensor 15.

With the above configurations, the transport delays of the purge air, the intake air and the fuel can be calculated based on the simple primary or first order delay elements (the intake system delay model 203 and the exhaust system delay model 205) and the internal combustion engine stroke delay element (the fuel stroke delay model 204).

Further, the purge air concentration calculation section 28 calculates the purge air concentration Nprg only when the air fuel ratio sensor neighborhood purge rate Rprgex is larger than the first predetermined purge rate $\alpha$, so it is possible to calculate the purge air concentration Nprg in a more accurate manner.

Furthermore, the fuel amount correction section 30 based on the combustion chamber purge rate Rprgin and the purge air concentration Nprg performs fuel amount correction due to the purge flow rate only when the combustion chamber purge rate Rprgin is larger than the predetermined purge rate $\beta$, so the fuel amount correction due to the purge flow rate can be carried out more accurately.

In addition, the purge flow control section 23 controls the purge flow rate by using, as an upper limit value of the air fuel ratio sensor neighborhood purge rate Rprgex, the third predetermined purge rate larger than the second predetermined purge rate $\beta$ until the purge air concentration Nprg is first calculated by the purge air concentration calculation section 28 after starting of the internal combustion engine 13. As a result, the variation of the air fuel ratio due to purge air can be suppressed at the time of non-learning of the purge air concentration.

Also, the purge flow control section 23 holds or reduces the purge flow rate to be introduced into the intake system when the fuel correction amount calculated by the fuel amount correction section 30 based on the combustion chamber purge rate Rprgin and the purge air concentration learning value Nprgf is larger than a predetermined correction amount. As a result, the fuel amount correction value is prevented from becoming the predetermined value or above, whereby the variation of the air fuel ratio due to purge air can be suppressed.

Moreover, when the purge air concentration Nprg calculated by the purge air concentration calculation section 28 is so large as to indicate a value equal to or higher than the predetermined value, the purge flow rate control section 23 sets the rate of change of increase of the flow rate of purge air introduced into the intake system of the internal combustion engine 13 smaller (i.e., limits the change speed of the purge flow rate). Accordingly, it is possible to suppress the variation of the air fuel ratio due to purge air.

Further, the purge air concentration learning value Nprgf calculated by the purge air concentration learning value calculation section 29 is cleared when it has not been updated over the predetermined period of time τ. As a result, it is possible to prevent an error or difference between the actual purge air concentration and the purge air concentration learning value Nprgf from becoming large upon re-introduction of purge air.

Embodiment 2

Though not particularly described in the above-mentioned first embodiment, an intake air amount decreasing correction section may be provided in the ECU 20 (see FIG. 1) for canceling out the amount of air contained in purge air.

In this case, the intake air amount decreasing correction section in the ECU 20 estimates the amount of air contained in purge air based on the purge flow rate controlled by the purge flow rate control section 23 and the purge air concentration Nprg calculated by the purge air concentration calculation section 28, and corrects the amount of intake air flowing from the throttle valve 8 or an ISC valve into the intake system by decreasing it by the amount of air that is contained in the purge air.

Specifically, a control apparatus for an internal combustion engine according to a second embodiment of the present invention includes, in addition to the functions of the above-mentioned first embodiment, an air amount calculation function to estimate the amount of air contained in the purge air based on the target purge flow rate Qprgt and the purge air concentration learning value Nprgf, and an intake air amount correction function to correct the amount of intake air flowing from the throttle valve 8 or the ISC valve into the intake system of the internal combustion engine 13 by decreasing it by an amount corresponding to the amount of air thus estimated.

Figure 9:
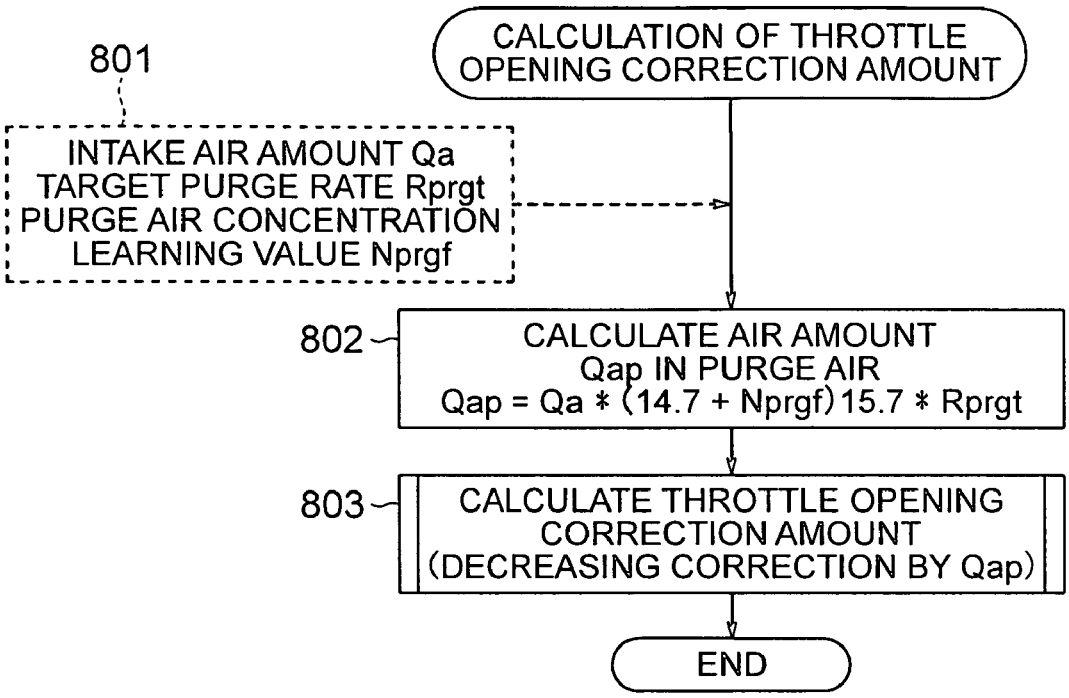
FIG. 9 is a flow chart illustrating a processing routine to calculate a throttle opening correction amount according to a second embodiment of the present invention.

Now, reference will be made to processing operation according to the second embodiment of the present invention while referring to a flow chart in FIG. 9. FIG. 9 illustrates a processing routine to calculate a throttle opening correction amount according to the second embodiment of the present invention. In this case, specifically, a subroutine shown in FIG. 9 is added to the subroutine previously described in the above-mentioned first embodiment.

In FIG. 9, the intake air amount decreasing correction section in the ECU 20 first calculates an amount of air Qap in the purge air by using the above-mentioned amount of intake air Qa, the target purge rate Rprgt and the purge air concentration learning value Nprgf (step 801) (step 802).

Here, note that the ordinary intake air amount control of the internal combustion engine 13 is mainly achieved by the throttle valve 8. For example, in the case of the throttle valve 8 of the electronically controlled type, it is possible to control the amount of intake air from an idle state (with the throttle valve 8 fully closed or substantially fully closed) to a fully opened state only by means of the opening and closing control of the throttle valve 8. On the other hand, in the case of the throttle valve 8 of the mechanically controlled type, the above-mentioned ISC valve (not shown) is used together, in addition to the throttle valve 8, for controlling the amount of intake air during idling.

Since the amount of air Qap in the purge air calculated in step 802 is different from the amount of intake air supplied through the throttle valve 8 that is driven by the driver's intention, the amount of air differing from the driver's intention is introduced from outside into the surge tank 7. That is, there is a possibility that a vehicle with the internal combustion engine 13 installed thereon might be accelerated at the start of purge introduction, or on the contrary, there is the possibility of inviting deterioration in driveability such as the vehicle being decelerated against the driver's intention during purge cut.

Accordingly, following the step 802, the amount of intake air is corrected to decrease by the calculated amount of air Qap in the purge air (step 803), and the processing routine of FIG. 9 is terminated. At this time, in step 803, the throttle opening is corrected to decrease in the case of the throttle valve 8 being of the electronic type, while the degree of opening of the ISC valve is corrected to decrease in the case of the throttle valve 8 being of the mechanical type.

As described above, according to the second embodiment of the present invention, by correcting the amount of intake air by decreasing and canceling an amount corresponding to the amount of air in the purge air from the intake air by means of the throttle valve 8 or the ISC valve, it is possible to avoid unintentional acceleration and deceleration of the vehicle against the driver's will, and hence to keep good driveability. In particular, there is obtained an advantageous effect that the driver is not caused to have an abnormal acceleration or deceleration feeling at the time of a change in the purge flow rate such as at the start of purge introduction, at the time of purge cut, etc.

Embodiment 3

Figure 10:
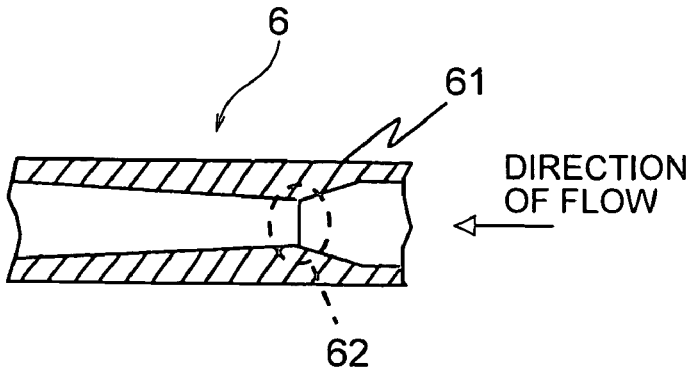
FIG. 10 is a cross sectional view showing the structure of a sonic nozzle used in a purge control valve according to a third embodiment of the present invention.

Though not particularly described in the above-mentioned first and second embodiments, a sonic nozzle (e.g., a Laval nozzle or also called a contraction and expansion tube) may be arranged in an internal passage of the purge control valve 6 used in the evaporated fuel treatment device, as shown in FIG. 10. FIG. 10 is a cross sectional view that shows the internal passage in the control valve 6 according to a third embodiment of the present invention, in which the construction unillustrated herein is similar to the corresponding one in the above-mentioned embodiments.

In FIG. 10, the purge control valve 6 has a structure using the sonic nozzle, with an orifice or restricted portion 62 being formed in a part of an internal passage 61. Here, the sonic nozzle will be described in some detail. By the provision of the restricted portion 62 in a part of the internal passage 61 for purge air, as shown in FIG. 10, when the internal pressure of the surge tank 7 (i.e., pressure in the intake system) in the internal combustion engine 13 falls below a prescribed or fixed value, there occurs a phenomenon that the flow speed of purge air in the restricted portion 62 becomes the speed of sound. Thereafter, even if the internal pressure of the surge tank 7 further lowers, the flow speed in the restricted portion 62 never exceeds the speed of sound, as a result, the flow rate of purge air passing through the purge control valve 6 in the form of the sonic nozzle becomes constant irrespective of the pressure in the surge tank 7.

Thus, according to this third embodiment, by using the sonic nozzle for the internal passage 61 of the purge control valve 6, the flow rate of the purge air passing through the purge control valve 6 becomes substantially constant even when the internal pressure of the surge tank 7 suddenly changes for example in the transient operation of the internal combustion engine 13. As a result, the control accuracy of the purge flow rate during the transient operation can be improved as compared with the aforementioned conventional purge control valve.

Accordingly, the estimation accuracy of the purge air concentration learning value Nprgf and the accuracy of fuel amount correction due to the purge flow rate can be improved, thus making it possible to further suppress the variation of the air fuel ratio during the transient operation. Specifically, by using the sonic nozzle as the purge control valve 6 of the duty control type, the purge flow rate with respect to the drive duty of the purge control valve 6 becomes constant regardless of the pressure in the surge tank 7, and hence does not receive the influence of pressure change in the surge tank 7 during the transient operation, so the control accuracy of the purge flow rate can be further improved.

Embodiment 4

Although in the above-mentioned first through third embodiments, the purge control valve 6 and the injector 12 are controlled for the evaporated fuel generated when the canister 3 is purged, the blowby gas control valve and the injector 12 may instead be controlled with a blowby gas being made a target to be controlled.

Hereinafter, reference will be made to a fourth embodiment of the present invention in which a blowby gas is to be controlled. A control apparatus for an internal combustion engine according to the fourth embodiment of the present invention is basically similar in the overall construction to the above-mentioned one (see FIG. 1) except for a blowby gas passage and a blowby gas control valve (not shown) with which the purge passage 5 and the purge control valve 6 in FIG. 1 are replaced, respectively. Also, the configuration of the ECU 20 is basically similar to that of the above-mentioned one (see FIG. 2) only except for a blowby gas ratio, an amount of blowby gas, and a blowby gas concentration with which the purge rate, the purge flow rate and the purge air concentration in FIG. 2 are replaced, respectively. In this case, in place of evaporated fuel from the canister 3, evaporated fuel (blowby gas) that leaks from a gap between a cylinder of the internal combustion engine 13 and a piston received therein into the crankcase is made a parameter to be controlled, but even when the blowby gas is processed or treated in this manner, control processing similar to the above-mentioned one can be applied. Specifically, when the blowby gas is connected or supplied to the surge tank, an electronic control valve having performance equivalent to the above-mentioned purge control valve 6 (see FIG. 1) can be used in place of a generally used PCV valve of the mechanical type, and controlled in the same manner as stated above.

The control apparatus for an internal combustion engine according to the fourth embodiment of the present invention includes, in the above-mentioned construction (see FIGS. 1 and 2), the blowby gas control valve arranged in the blowby gas passage, the injector 12 for supplying fuel to the internal combustion engine 13, the air fuel ratio sensor 15 for detecting the air fuel ratio of the exhaust gas, a target blowby gas ratio calculation section, a target blowby gas amount calculation section, a blowby gas amount control section, and an air fuel ratio feedback control section. These sections are included in the ECU 20.

The blowby gas control valve controls the amount of blowby gas when the blowby gas comprising a mixture of evaporated fuel and air leaking from the gap between the cylinder and the piston of the internal combustion engine 13 into the crankcase is introduced into the intake system of the internal combustion engine 13.

The target blowby gas ratio calculation section in the ECU 20 calculates, as a target blowby gas ratio, a target value of the blowby gas ratio, which is a ratio between the amount of intake air of the internal combustion engine 13 and the amount of blowby gas, based on the operating condition of the internal combustion engine 13.

The target blowby gas amount calculation section in the ECU 20 calculates a target blowby gas amount based on the operating condition of the internal combustion engine 13 and the target blowby gas ratio, and the blowby gas amount control section controls the blowby gas control valve in such a manner that the actual amount of blowby gas becomes the target blowby gas amount.

The air fuel ratio feedback control section controls the amount of fuel supplied from the injector 12 in a feedback manner so that the air fuel ratio becomes the target air fuel ratio.

In addition, the ECU 20 according to the fourth embodiment of the present invention further includes a blowby gas transport delay calculation section, an intake air transport delay calculation section, a fuel transport delay calculation section, a combustion chamber blowby gas ratio calculation section, an air fuel ratio sensor neighborhood blowby gas ratio calculation section, a blowby gas concentration calculation section, a blowby gas concentration learning value calculation section, and a fuel amount correction section.

The blowby gas transport delay calculation section in the ECU 20 calculates a combustion chamber blowby gas amount based on a transport delay that occurs until the blowby gas supplied to the intake system through the blowby gas control valve arrives at the combustion chamber, and also calculates an air fuel ratio sensor neighborhood blowby gas amount based on a transport delay that occurs until the blowby gas influences the value of the air fuel ratio detected by the air fuel ratio sensor.

Similarly, the intake air transport delay calculation section calculates a combustion chamber intake air amount based on a transport delay that occurs until the intake air detected by the variety of kinds of sensors 19 (operating condition detection section) reaches the interior of the combustion chamber, and also calculates an air fuel ratio sensor neighborhood intake air amount based on a transport delay that occurs until the intake air exerts an influence on the value of the air fuel ratio detected by the air fuel ratio sensor 15.

The fuel transport delay calculation section calculates an air fuel ratio sensor neighborhood fuel amount based on a transport delay that occurs until the fuel supplied by the injector 12 exerts an influence on the value of the air fuel ratio detected by the air fuel ratio sensor 15.

The combustion chamber blowby gas ratio calculation section calculates a combustion chamber blowby gas ratio based on the combustion chamber blowby gas amount and the combustion chamber intake air amount.

The air fuel ratio sensor neighborhood blowby gas ratio calculation section calculates an air fuel ratio sensor neighborhood blowby gas ratio based on the air fuel ratio sensor neighborhood blowby gas amount and the air fuel ratio sensor neighborhood intake air amount.

The blowby gas concentration calculation section calculates a blowby gas concentration based on the air fuel ratio sensor neighborhood blowby gas ratio, the air fuel ratio sensor neighborhood intake air amount, the air fuel ratio sensor neighborhood fuel amount, and the air fuel ratio detected by the air fuel ratio sensor 15.

The blowby gas concentration learning value calculation section calculates a blowby gas concentration learning value by applying averaging processing or filtering processing to the blowby gas concentration.

The fuel amount correction section corrects the amount of fuel supplied to the internal combustion engine 13 based on the combustion chamber blowby gas ratio and the blowby gas concentration learning value.

Thus, by using the electronic control valve as the blowby gas control valve in place of the PCV valve of the mechanical type, and by controlling the electronic control valve according to a method similar to that in the above-mentioned first through third embodiments, it is possible to reduce the influence of the blowby gas on the air fuel ratio, thereby further improving the purification performance of the blowby gas.

While the invention has been described in terms of preferred embodiments, those skilled in the art will recognize that the invention can be practiced with modifications within the spirit and scope of the appended claims.

What is claimed is:

1. A control apparatus for an internal combustion engine comprising:

a canister that temporarily adsorbs and stores evaporated fuel generated in a fuel supply system including a fuel tank;

a purge control valve that is arranged in a purge passage connecting between said canister and an intake system of an internal combustion engine for controlling the flow rate of purge air comprising a mixture of said evaporated fuel and air when said purge air is introduced into said intake system;

an injector that is arranged in the neighborhood of an intake port or in a combustion chamber of said internal combustion engine for supplying fuel to said internal combustion engine;

an operating condition detection section that detects an operating condition of said internal combustion engine;

an air fuel ratio sensor that is arranged in an exhaust system of said internal combustion engine for detecting an air fuel ratio in an exhaust gas;

a target purge rate calculation section that calculates, as a target purge rate, a target value of a purge rate that is a ratio between an amount of intake air of said internal combustion engine and said purge flow rate, based on said engine operating condition;

a target purge flow rate calculation section that calculates a target purge flow rate based on said engine operating condition and said target purge rate;

a purge flow rate control section that controls said purge control valve so that said purge flow rate becomes said target purge flow rate;

an air fuel ratio feedback control section that controls an amount of fuel supplied from said injector in a feedback manner so that said air fuel ratio becomes a target air fuel ratio;

a purge air transport delay calculation section that calculates a combustion chamber purge flow rate based on a transport delay that occurs until the purge air supplied to said intake system through said purge control valve reaches said combustion chamber, and also calculates an air fuel ratio sensor neighborhood purge flow rate based on a transport delay that occurs until said purge air exerts an influence on the value of said air fuel ratio detected by said air fuel ratio sensor;

an intake air transport delay calculation section that calculates a combustion chamber intake air amount based on a transport delay that occurs until intake air detected by said operating condition detection section reaches the interior of said combustion chamber, and also calculates an air fuel ratio sensor neighborhood intake air amount based on a transport delay that occurs until said intake air exerts an influence on the value of said air fuel ratio detected by said air fuel ratio sensor;

a fuel transport delay calculation section that calculates an air fuel ratio sensor neighborhood fuel amount based on a transport delay that occurs until the fuel supplied by said injector exerts an influence on the value of said air fuel ratio detected by said air fuel ratio sensor;

a combustion chamber purge rate calculation section that calculates a combustion chamber purge rate based on said combustion chamber purge flow rate and said combustion chamber intake air amount;

an air fuel ratio sensor neighborhood purge rate calculation section that calculates an air fuel ratio sensor neighborhood purge rate based on said air fuel ratio sensor neighborhood purge flow rate and said air fuel ratio sensor neighborhood intake air amount;

a purge air concentration calculation section that calculates a purge air concentration based on said air fuel ratio sensor neighborhood purge rate, said air fuel ratio sensor neighborhood intake air amount, said air fuel ratio sensor neighborhood fuel amount, and the air fuel ratio detected by said air fuel ratio sensor;

a purge air concentration learning value calculation section that calculates a purge air concentration learning value by applying averaging processing or filtering processing to said purge air concentration; and a fuel amount correction section that corrects the amount of fuel to be supplied to said internal combustion engine based on said combustion chamber purge rate and said purge air concentration learning value.

2. The control apparatus for an internal combustion engine as set forth in claim 1, wherein said purge air transport delay calculation section and said intake air transport delay calculation section include:

an intake system delay model that is modeled by using, as a primary delay element, a delay that occurs until the purge air and intake air supplied to said intake system arrive at said combustion chamber;

a combustion stroke delay model that is modeled by using a delay that occurs until said purge air and said intake air, after having arrived at said combustion chamber, are exhausted to said exhaust system through strokes necessary for combustion thereof according to the strokes of said internal combustion engine; and an exhaust system delay model that is modeled by using, as a primary delay element, a delay that occurs until said purge air and said intake air, after having been exhausted to said exhaust system, are detected by said air fuel ratio sensor;

said fuel transport delay calculation section includes:

said combustion stroke delay model that is modeled by using a delay that occurs until the fuel supplied from said injector, after having arrived at said combustion chamber, is exhausted to said exhaust system through strokes necessary for combustion thereof according to the strokes of said internal combustion engine; and said exhaust system delay model that is modeled by using, as a primary delay element, a delay that occurs until said fuel, after having been exhausted to said exhaust system, is detected by said air fuel ratio sensor.

3. The control apparatus for an internal combustion engine as set forth in claim 1, wherein said purge air concentration calculation section calculates said purge air concentration when said air fuel ratio sensor neighborhood purge rate is larger than a first predetermined purge rate.

4. The control apparatus for an internal combustion engine as set forth in claim 1, wherein said fuel amount correction section performs fuel amount correction due to said purge flow rate when said combustion chamber purge rate is larger than a second predetermined purge rate.

5. The control apparatus for an internal combustion engine as set forth in claim 4, wherein said purge flow control section controls said purge flow rate by using, as an upper limit value of said air fuel ratio sensor neighborhood purge rate, a third predetermined purge rate larger than said second predetermined purge rate until said purge air concentration is first calculated after starting of said internal combustion engine.

6. The control apparatus for an internal combustion engine as set forth in claim 1, wherein said purge flow control section holds or reduces the flow rate of purge air introduced into said intake system when the fuel correction amount calculated by said fuel amount correction section is larger than or equal to a predetermined correction amount.

7. The control apparatus for an internal combustion engine as set forth in claim 1, wherein said purge flow control section sets the rate of change of increase of the flow rate of purge air introduced into said intake system small when said purge air concentration is higher than a predetermined purge air concentration.

8. The control apparatus for an internal combustion engine as set forth in claim 1, wherein said purge air concentration learning value calculation section clears said purge air concentration learning value when said purge air concentration learning value has not been updated over a predetermined period of time.

9. The control apparatus for an internal combustion engine as set forth in claim 1, further comprising an intake air amount decreasing correction section, wherein said intake air amount decreasing correction section estimates an amount of air contained in said purge air based on the purge flow rate controlled by said purge flow rate control section and the purge air concentration calculated by said purge air concentration calculation section, and corrects the amount of intake air flowing from a throttle valve or an ISC valve into said intake system by decreasing it by an amount of air that is contained in said purge air.

10. The control apparatus for an internal combustion engine as set forth in claim 1, wherein said purge control valve comprises a purge control valve that uses a sonic nozzle having an internal passage with a restricted portion formed in a part thereof; and the flow speed in said restricted portion becomes the speed of sound when pressure in said intake system is lower than or equal to a fixed value.

11. A control apparatus for an internal combustion engine comprising:

a blowby gas control valve that controls an amount of blowby gas when the blowby gas comprising a mixture of evaporated fuel and air leaking from a gap between a cylinder and a piston of an internal combustion engine into a crankcase is introduced into an intake system of said internal combustion engine;

an injector that is arranged in the neighborhood of an intake port or in a combustion chamber of said internal combustion engine for supplying fuel to said internal combustion engine;

an operating condition detection section that detects an operating condition of said internal combustion engine;

an air fuel ratio sensor that is arranged in an exhaust system of said internal combustion engine for detecting an air fuel ratio in an exhaust gas;

a target blowby gas ratio calculation section that calculates, as a target blowby gas ratio, a target value of a blowby gas ratio, which is a ratio between an amount of intake air of said internal combustion engine and said amount of blowby gas, based on said engine operating condition;

a target blowby gas amount calculation section that calculates a target blowby gas amount based on said engine operating condition and said target blowby gas ratio;

a blowby gas amount control section that controls said blowby gas control valve so that said amount of blowby gas becomes said target blowby gas amount;

an air fuel ratio feedback control section that controls an amount of fuel supplied from said injector in a feedback manner so that said air fuel ratio becomes a target air fuel ratio;

a blowby gas transport delay calculation section calculates a combustion chamber blowby gas amount based on a transport delay that occurs until the blowby gas supplied to said intake system through said blowby gas control valve arrives at said combustion chamber, and also calculates an air fuel ratio sensor neighborhood blowby gas amount based on a transport delay that occurs until said blowby gas exerts an influence on the value of said air fuel ratio detected by said air fuel ratio sensor;

an intake air transport delay calculation section that calculates a combustion chamber intake air amount based on a transport delay that occurs until intake air detected by said operating condition detection section reaches the interior of said combustion chamber, and also calculates an air fuel ratio sensor neighborhood intake air amount based on a transport delay that occurs until said intake air exerts an influence on the value of said air fuel ratio detected by said air fuel ratio sensor;

a fuel transport delay calculation section that calculates an air fuel ratio sensor neighborhood fuel amount based on a transport delay that occurs until the fuel supplied by said injector exerts an influence on the value of said air fuel ratio detected by said air fuel ratio sensor;

a combustion chamber blowby gas ratio calculation section that calculates a combustion chamber blowby gas ratio based on said combustion chamber blowby gas amount and said combustion chamber intake air amount;

an air fuel ratio sensor neighborhood blowby gas ratio calculation section that calculates an air fuel ratio sensor neighborhood blowby gas ratio based on said air fuel ratio sensor neighborhood blowby gas amount and said air fuel ratio sensor neighborhood intake air amount;

a blowby gas concentration calculation section that calculates a blowby gas concentration based on said air fuel ratio sensor neighborhood blowby gas ratio, said air fuel ratio sensor neighborhood intake air amount, said air fuel ratio sensor neighborhood fuel amount, and said air fuel ratio detected by said air fuel ratio sensor;

a blowby gas concentration learning value calculation section that calculates a blowby gas concentration learning value by applying averaging processing or filtering processing to said blowby gas concentration; and a fuel amount correction section that corrects the amount of fuel to be supplied to said internal combustion engine based on said combustion chamber blowby gas ratio and said blowby gas concentration learning value.

* * * * *